US011098929B2

(12) United States Patent
Vijayan et al.

(10) Patent No.: US 11,098,929 B2
(45) Date of Patent: Aug. 24, 2021

(54) FAST SWITCHING MULTIPLE EVAPORATOR SYSTEM FOR AN APPLIANCE

(71) Applicant: Haier US Appliance Solutions, Inc., Wilmington, DE (US)

(72) Inventors: Vineeth Vijayan, Louisville, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 327 days.

(21) Appl. No.: 16/244,224

(22) Filed: Jan. 10, 2019

(65) Prior Publication Data

US 2020/0224930 A1 Jul. 16, 2020

(51) Int. Cl.

| | |
|---|---|
| ***F25B 5/02*** | (2006.01) |
| ***F25B 41/22*** | (2021.01) |
| ***F25B 5/04*** | (2006.01) |
| ***F25B 41/37*** | (2021.01) |

(52) U.S. Cl.

CPC ..... *F25B 5/02* (2013.01); *F25B 41/22* (2021.01); *F25B 41/37* (2021.01); *F25B 5/04* (2013.01); *F25B 2400/23* (2013.01); *F25B 2600/2519* (2013.01)

(58) Field of Classification Search

CPC ..... F25B 5/02; F25B 5/04; F25B 2600/2515; F25B 2400/23; F25B 41/22

See application file for complete search history.

(56) References Cited

U.S. PATENT DOCUMENTS

| | | | | |
|---|---|---|---|---|
| 5,056,328 | A * | 10/1991 | Jaster | F25D 29/00 62/180 |
| 5,184,473 | A * | 2/1993 | Day | F25B 41/22 62/199 |
| 5,465,591 | A * | 11/1995 | Cur | F25B 5/02 62/199 |
| 9,714,785 | B2 * | 7/2017 | Cur | F25D 11/006 |
| 9,970,698 | B2 * | 5/2018 | Gomes | F25D 11/022 |
| 2011/0185760 | A1 * | 8/2011 | Suh | F25B 5/00 62/344 |

FOREIGN PATENT DOCUMENTS

WO WO2018121425 A1 7/2018

* cited by examiner

*Primary Examiner* — Frantz F Jules
*Assistant Examiner* — Lionel Nouketcha
(74) *Attorney, Agent, or Firm* — Dority & Manning, P.A.

(57) ABSTRACT

Various embodiments of a multi-evaporator sealed vapor compression system for an appliance are provided. In one example aspect, a sealed system charged with a refrigerant fluid includes a single compressor and a first and second evaporator fluidly coupled in series. A flash tank is positioned between the evaporators. One or more valves are fluidly coupled with and positioned downstream of the flash tank and the second evaporator. The valves are operable to selectively switch the flow of refrigerant fluid between the two evaporators at a frequency such that the temperature rise in the evaporators is negligible. In another aspect, a sealed system charged with a refrigerant fluid includes a single compressor and a first and second evaporator fluidly coupled in parallel. One or more valves positioned upstream of the evaporators and one or more valves are positioned downstream of the evaporators for controlling the refrigerant flow through the sealed system.

24 Claims, 10 Drawing Sheets

FAST SWITCHING MULTIPLE EVAPORATOR SYSTEM FOR AN APPLIANCE

FIELD OF THE INVENTION

The subject matter of the present disclosure relates generally to a multi-evaporator sealed system for an appliance.

BACKGROUND OF THE INVENTION

Some appliances include sealed vapor compression systems for conditioning an enclosed space or chamber. For instance, certain refrigerator appliances include sealed systems for cooling chilled chambers of the refrigerator appliance. The sealed systems generally include a compressor that compresses a refrigerant during operation of the sealed system. The compressed refrigerant flows to an evaporator where heat exchange between the chilled chambers and the refrigerant cools the chilled chambers and food items located therein.

Manufacturers of appliances continue to push for more energy efficient appliances. The primary path employed by manufacturers to improve the energy performance of their appliances that run on vapor compression systems is implementing energy efficient sealed system components, including e.g., advanced heat exchangers and compressors. However, these advanced sealed system components are quickly reaching their limits of efficiency. For example, compressor efficiencies of household refrigerators are peaking around an Energy Efficiency Ratio (EER) of 8. Accordingly, manufacturers have turned to appliances that utilize multi-evaporator systems (multi-stage cycles) to further energy efficiency improvements of appliances.

Conventional multi-evaporator sealed systems can include multiple evaporators operating in series, parallel or a hybrid mode. In parallel and hybrid modes, the evaporators are under sequential operation. Stated differently, flow is directed through one or more evaporators for several minutes before being switched to the other evaporator(s) at a different pressure. Simultaneous operation is generally not feasible. Simultaneous parallel operation with two separate evaporating pressures may have more efficiency benefits than the above mentioned sequential methods. However, such parallel systems require either the use of multiple compressors or a complicated design of an ejector or some other means of pressure equalization at the suction side of the compressor. In the series mode, simultaneous series evaporator operation with a flash tank also has high potential for efficiency and capacity improvements. However, such systems also require the use of multiple compressors or a compressor capable of vapor injection or an ejector design.

Accordingly, an improved sealed system for appliance that addresses one or more of the challenges noted above would be useful.

BRIEF DESCRIPTION OF THE INVENTION

Aspects and advantages of the invention will be set forth in part in the following description, or may be apparent from the description, or may be learned through practice of the invention.

In one example embodiment, a sealed system for an appliance is provided. The sealed system includes a compressor having an inlet and an outlet. The sealed system also includes a condenser fluidly coupled with the outlet of the compressor and operable to receive a refrigerant fluid from the compressor. Further, the sealed system includes a first expansion device fluidly coupled with an outlet of the condenser and a first evaporator fluidly coupled with an outlet of the first expansion device and operable to output the refrigerant fluid at a first outlet pressure. In addition, the sealed system includes a second evaporator fluidly coupled with the first evaporator in series and operable to output the refrigerant fluid at a second outlet pressure that is different than the first outlet pressure. Moreover, the sealed system includes a flash tank fluidly coupled with the first evaporator and the second evaporator and positioned therebetween, the flash tank having a vapor outlet and a liquid outlet, the second evaporator positioned between the liquid outlet of the flash tank and the inlet of the compressor. A second expansion device is positioned between and fluidly coupled with the liquid outlet of the flash tank and the second evaporator. Further, the sealed system includes one or more valves operable to selectively switch a flow of the refrigerant fluid to the inlet of the compressor between: i) the vapor outlet of the flash tank and the inlet of the compressor, and ii) the liquid outlet of the flash tank and the inlet of the compressor through the second evaporator, wherein the one or more valves selectively switch the flow of the refrigerant fluid to the inlet of the compressor at a frequency such that a temperature increase in the first evaporator and the second evaporator is negligible during operation of the one or more valves.

In another example embodiment, a sealed system for an appliance is provided. The sealed system includes a compressor having an inlet and an outlet and a condenser fluidly coupled with the outlet of the compressor and operable to receive a refrigerant fluid from the compressor. Further, the sealed system includes a first conduit and a second conduit. The sealed system also includes a first expansion device positioned along the first conduit and fluidly coupled with the condenser. The sealed system further includes a first evaporator positioned along the first conduit downstream of the first expansion device, the first evaporator operable to output the refrigerant fluid at a first outlet pressure. Moreover, the sealed system includes a second expansion device positioned along the second conduit and fluidly coupled with the condenser. The sealed system also includes a second evaporator positioned along the second conduit downstream of the second expansion device and fluidly coupled with the first evaporator in parallel, the second evaporator operable to output the refrigerant fluid at a second outlet pressure that is different than the first outlet pressure. In addition, the sealed system includes one or more upstream valves positioned downstream of the condenser and upstream of the first evaporator and the second evaporator, the one or more upstream valves operable to selectively allow a flow of the refrigerant fluid along at least one of i) the first conduit, and ii) the second conduit. Further, the sealed system includes one or more downstream valves operable to selectively switch the flow of the refrigerant fluid to the inlet of the compressor between: i) the first conduit and the inlet of the compressor, and ii) the second conduit and the inlet of the compressor, wherein, in coordination, the one or more downstream valves and the one or more upstream valves selectively switch the flow of the refrigerant fluid to the inlet of the compressor at a frequency such that a temperature increase in the first evaporator and the second evaporator is negligible during operation of the one or more downstream valves and the one or more upstream valves.

In yet another example embodiment, a method for operating a sealed system of an appliance is provided. The method includes flowing a refrigerant fluid through a refrigerant fluid circuit of the sealed system having a compressor, a condenser, a first expansion device, a first evaporator, a flash tank, a second expansion device, and a second evaporator fluidly coupled in series. The refrigerant fluid circuit has a first supply conduit that fluidly couples a vapor outlet of the flash tank with an inlet of the compressor and a second supply conduit that fluidly couples a liquid outlet of the flash tank with the inlet of the compressor through the second evaporator. The second expansion device and the second evaporator are positioned between the flash tank and the compressor along the second supply conduit and the first evaporator is positioned between the condenser and the flash tank along the refrigerant fluid circuit. Further, the method includes switching one or more valves positioned between the flash tank and the compressor to switch a flow of the refrigerant fluid to the inlet of the compressor between: i) the vapor outlet of the flash tank and the inlet of the compressor along the first supply conduit, and ii) the liquid outlet of the flash tank and the inlet of the compressor along the second supply conduit, wherein the one or more valves selectively switch the flow of the refrigerant fluid to the inlet of the compressor at a frequency based at least in part on a heat load applied on the first evaporator and a heat load applied on the second evaporator.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
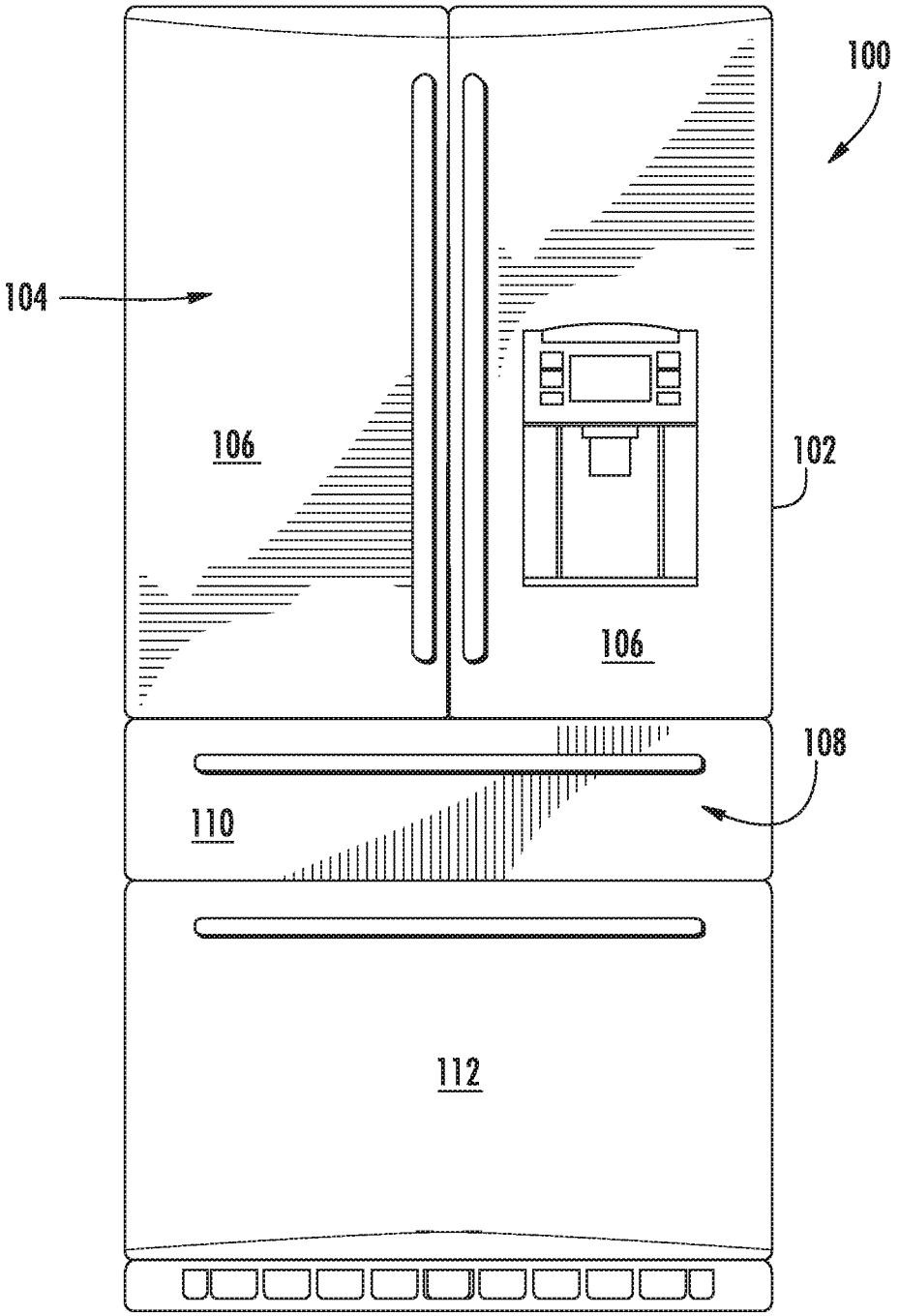
FIG. 1 provides a front view of a refrigerator appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "approximately," "substantially," or "about," refer to being within a ten percent (10%) margin of error of the stated value. Moreover, as used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Figure 2:
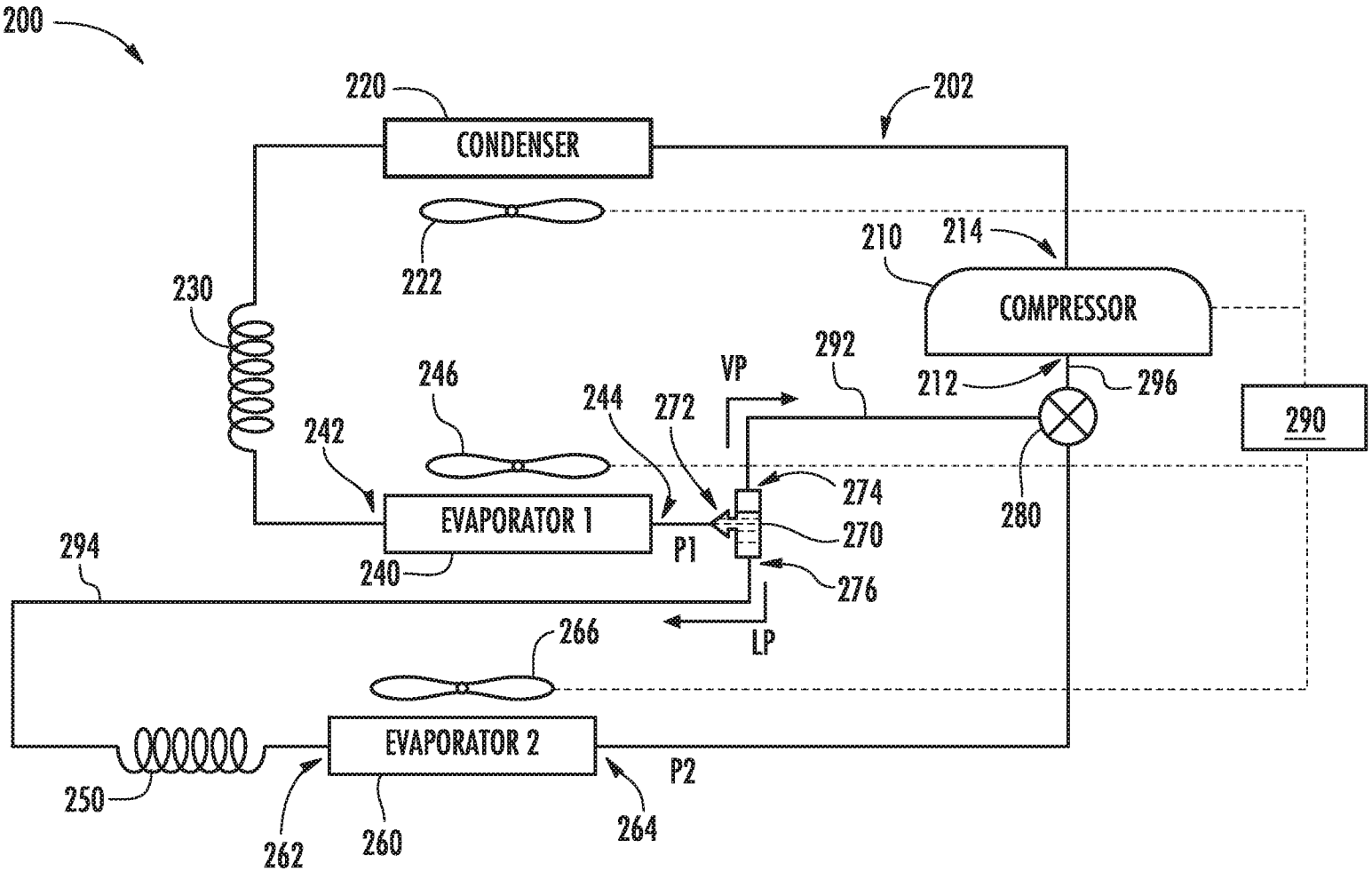
FIG. 2 provides a schematic view of a sealed vapor compression system for an appliance according to an example embodiment of the present subject matter.

FIG. 1 provides a refrigerator appliance 100 that incorporates a sealed vapor compression system 200 (FIG. 2). It should be appreciated that the term "refrigerator appliance" is used herein in a generic sense to encompass any type of refrigeration appliance, such as a freezer, refrigerator/freezer combination, and any style or refrigerator model. In addition, it should be understood that the present subject matter is not limited to use in refrigeration appliances. For instance, the present subject matter can also be employed in other types of appliances, such as e.g., air conditioners, water heaters, heat pump dryers, and other appliances employing sealed vapor compression systems.

In the illustrated example embodiment shown in FIG. 1, refrigerator appliance 100 is depicted as an upright refrigerator having a cabinet or casing 102 that defines a number of internal chilled chambers. In particular, casing 102 of refrigerator appliance 100 defines a fresh food chamber 104 enclosed by doors 106 rotatably mounted to casing 102. Casing 102 also defines a freezer chamber 108 enclosed by an upper drawer 110 and a lower drawer 112. The drawers 110, 112 can be "pull-out" drawers in that they can be manually moved into and out of the freezer chamber 108 on suitable slide mechanisms.

FIG. 2 provides a schematic view of sealed vapor compression system 200 according to an example embodiment of the present subject matter. For instance, the sealed vapor compression system 200 of FIG. 2 can be employed in the refrigerator appliance 100 of FIG. 1 for cooling air within refrigerator appliance 100, e.g., within the chilled chambers 104, 108. Thus, in such embodiments, sealed vapor compression system 200 can be a sealed refrigeration system. Various components of sealed vapor compression system 200 can be housed within a machinery compartment defined by casing 102 (FIG. 1) of refrigerator appliance 100, for example. Furthermore, the example sealed vapor compression system 200 of FIG. 2 can be employed in other suitable types of appliances, such as e.g., air conditioners, water heaters, heat pump dryers, and other appliances employing sealed vapor compression systems. Moreover, the example sealed systems described herein are not limited to execution of vapor compression refrigeration cycles and may apply to other types of cycles, such as e.g., a heat pump cycle.

As shown in FIG. 2, sealed system 200 is a multi-evaporator sealed system operable to execute a vapor compression cycle. Generally, sealed system 200 includes a plurality of conduits fluidly coupling various components to form a refrigerant fluid circuit 202 charged with a refrigerant fluid. In particular, sealed system 200 includes a compressor 210 having an inlet 212 and an outlet 214. Compressor 210 is operable to compress the gaseous refrigerant fluid, e.g., to increase the pressure of the refrigerant fluid. The compression of the gaseous refrigerant fluid also raises its temperature. Compressor 210 can be any suitable type of compressor, such as e.g., a linear or rotary compressor. For this embodiment, compressor 210 is the only compressor of sealed system 200.

Sealed system 200 also includes a condenser 220 fluidly coupled with the outlet 214 of compressor 210. More particularly, for this embodiment, an inlet of condenser 220 is fluidly connected to the outlet 214 of compressor 210. Condenser 220 is operable to receive refrigerant fluid from compressor 210. More specifically, the compressed refrigerant fluid flows into compressor 210 where heat exchange with ambient air takes place so as to cool the refrigerant and cause the refrigerant to condense to a liquid state. For this embodiment, a condenser fan 222 is operable to move air across condenser 220 so as to provide forced convection for a more rapid and efficient heat exchange between the refrigerant within condenser 220 and the ambient air. Increasing air flow across condenser 220 can, e.g., increase the efficiency of condenser 220 by improving cooling of the refrigerant contained therein.

Sealed system 200 also includes a first expansion device 230 fluidly coupled with condenser 220. Particularly, first expansion device 230 is fluidly connected with an outlet of condenser 220. First expansion device 230 can be any suitable type of expansion device, such as e.g., a capillary tube, an expansion valve, etc. For the depicted embodiment of FIG. 2, first expansion device 230 is a capillary tube operable to reduce the pressure of the refrigerant fluid flowing downstream from condenser 220 and meter the flow of the refrigerant fluid.

Sealed system 200 further includes multiple evaporators fluidly coupled in series, including a first evaporator 240 and a second evaporator 260. In other example embodiments, however, sealed system 200 can include more than two (2) evaporators fluidly coupled in series. First evaporator 240 is fluidly coupled with condenser 220. More specifically, for this embodiment, first evaporator 240 is fluidly connected with an outlet of first expansion device 230, which is turn fluidly connected with the outlet of condenser 220 as noted above. Thus, first expansion device 230 is fluidly coupled with and positioned between condenser 220 and first evaporator 240. First evaporator 240 has an inlet side 242 and an outlet side 244. First evaporator 240 is operable to receive refrigerant fluid at the inlet side 242 and operable to output refrigerant fluid at outlet side 244 at a first outlet pressure P1. Particularly, upon exiting first expansion device 230 and entering first evaporator 240, the refrigerant fluid in a generally liquid state drops in pressure and temperature. Due to the pressure drop and phase change of the refrigerant fluid from a generally liquid state to a generally vapor state, first evaporator 240 is cool relative to the space to be conditioned, such as e.g., chilled chambers 104, 108 of refrigerator appliance 100 (FIG. 1). As such, cooled air is produced and refrigerates the space to be conditioned, e.g., chambers 104, 108 of refrigerator appliance 100. For this embodiment, a first evaporator fan 246 is operable to move air across first evaporator 240 so as to provide forced convection to more efficiently move conditioned air, e.g., into a chilled chamber of a refrigerator appliance. Thus, for this embodiment, first evaporator 240 is a type of heat exchanger that transfers heat from air passing over first evaporator 240 to refrigerant flowing through first evaporator 240.

Sealed system 200 includes a flash chamber or flash tank 270 fluidly coupled with first evaporator 240 and second evaporator 260 and is positioned therebetween. Flash tank 270 has an inlet 272, a vapor outlet 274, and a liquid outlet 276. Inlet 272 of flash tank 270 is fluidly connected with the outlet side 244 of first evaporator 240. In this way, refrigerant fluid flows from outlet side 244 of first evaporator 240 to inlet 272 of flash tank 270. A first supply conduit 292 fluidly couples the vapor outlet 274 of flash tank 270 and the inlet 212 of compressor 210. A second supply conduit 294 fluidly couples the liquid outlet 276 of flash tank 270 and the inlet 212 of compressor 210. Generally, flash tank 270 is operable to separate a phase of the refrigerant fluid into a primarily vapor phase VP and a primarily liquid phase LP. The primarily vapor phase VP can rise to the top of flash tank 270 and the primarily liquid phase LP can settle on the bottom of flash tank 270. As depicted in FIG. 2, the primarily vapor phase VP can flow to the inlet 212 of compressor 210 via first supply conduit 292 (depending on the position of one or more valves positioned downstream of flash tank 270 along first supply conduit 292) and the primarily liquid phase LP can flow to second evaporator 260 via second supply conduit 294.

For this embodiment, a number of components are positioned along second supply conduit 294. Specifically, second evaporator 260 is positioned along second supply conduit 294 between the liquid outlet 276 of flash tank 270 and the inlet 212 of compressor 210 and a second expansion device 250 is positioned between the liquid outlet 276 of flash tank 270 and second evaporator 260 along second supply conduit 294. Second expansion device 250 is fluidly coupled with the liquid outlet 276 of flash tank 270 and second evaporator 260. Second evaporator 260 is fluidly coupled with first evaporator 240 in series, as noted above. Second evaporator 260 has an inlet side 262 and an outlet side 264. Second evaporator 260 is operable to receive refrigerant fluid at the inlet side 262 and operable to output refrigerant fluid at outlet side 264 at a second outlet pressure P2 that is different than the first outlet pressure P1 output by first evaporator 240. Particularly, for this embodiment, second expansion device 250 meters the flow of the refrigerant fluid (in the primarily liquid phase LP) and reduces the pressure of the refrigerant flowing along second supply conduit 294 from liquid outlet 276 of flash tank 270 to the inlet side 262 of second evaporator 260. Upon exiting second expansion device 250 and entering second evaporator 260, the refrigerant fluid in the primarily liquid phase LP drops in pressure and temperature. Due to the pressure drop and phase change of the refrigerant fluid from a generally liquid state to a generally vapor state, second evaporator 260 is cool relative to the space to be conditioned, such as e.g., one or both of chilled chambers 104, 108 of refrigerator appliance 100 (FIG. 1). As such, cooled air is produced and refrigerates the space to be conditioned. For this embodiment, a second evaporator fan 266 is operable to move air across second evaporator 260 so as to provide forced convection to more efficiently move conditioned air, e.g., into a chilled chamber of a refrigerator appliance or into an enclosed space. Thus, for this embodiment, second evaporator 260 is a type of heat exchanger that transfers heat from air passing over second evaporator 260 to refrigerant flowing through second evaporator 260. Second expansion device 250 can be any suitable type of expansion device, such as e.g., a capillary tube, an expansion valve, etc. For the depicted embodiment of FIG. 2, second expansion device 250 is a capillary tube.

As further shown in FIG. 2, sealed system 200 includes one or more valves. For this embodiment, the one or more valves of sealed system 200 include a single multiway valve 280. More particularly, for this example embodiment, the one or more valves include a single, three-way valve. As depicted, first supply conduit 292 fluidly couples the vapor outlet 274 of flash tank 270 and multiway valve 280 and second supply conduit 294 fluidly couples the liquid outlet 276 of flash tank 270 and multiway valve 280. A delivery conduit 296 fluidly couples multiway valve 280 and the inlet 212 of compressor 210.

Multiway valve 280 is switchable between multiple positions. For this embodiment, multiway valve 280 is switchable between a first open position and a second open position. In some embodiments, multiway valve 280 can additionally be switchable to a closed position or to other open positions, e.g., so that other supply conduits in which other evaporators can flow refrigerant fluid to compressor 210. Notably, the one or more valves of sealed system 200 are operable to selectively switch the refrigerant flow to the inlet 212 of compressor 210 between: i) the vapor outlet 274 of flash tank 270 and the inlet 212 of compressor 210, and ii) the liquid outlet 276 of flash tank 270 and the inlet 212 of compressor 210. More particularly, for this embodiment, multiway valve 280 is operable to selectively switch the refrigerant flow to the inlet 212 of compressor 210 between: i) the vapor outlet 274 of flash tank 270 and the inlet 212 of compressor 210, and ii) the liquid outlet 276 of flash tank 270 and the inlet 212 of compressor 210.

Figure 3:
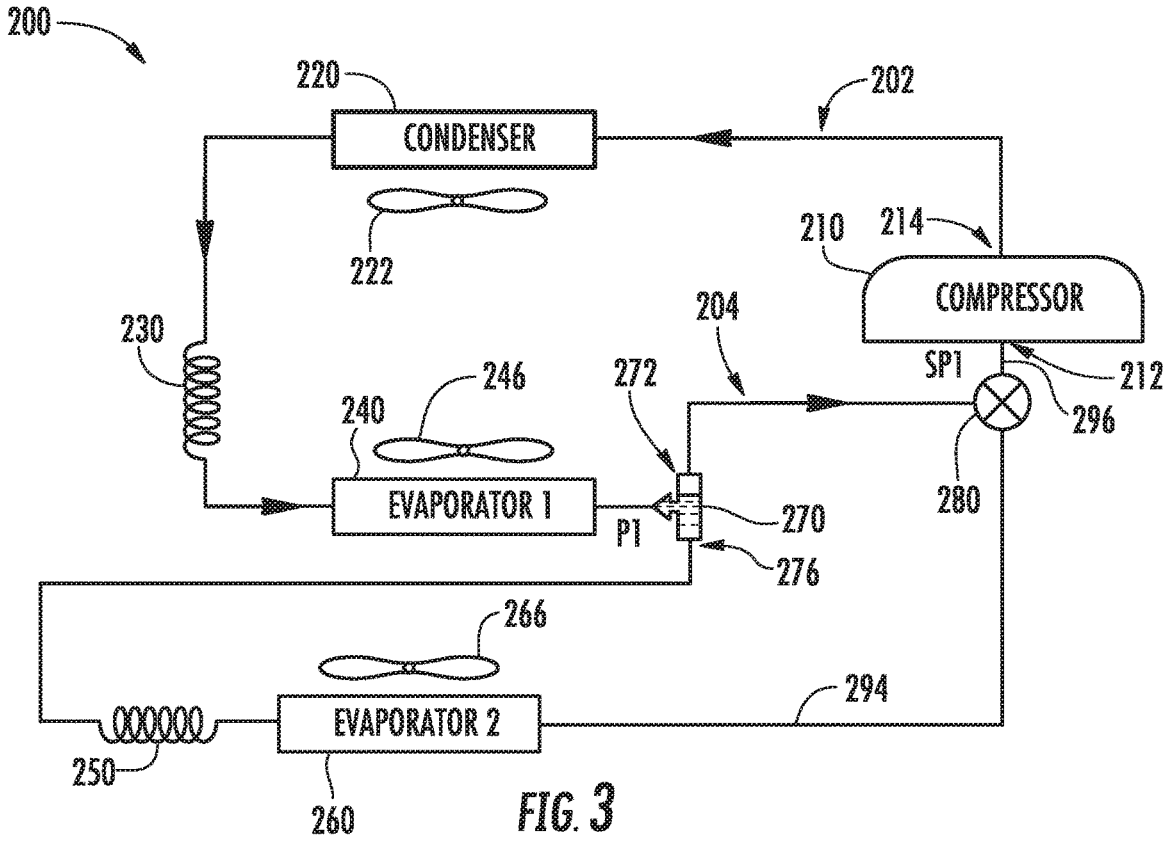
FIG. 3 provides another schematic view of the sealed vapor compression system of FIG. 2 and depicts refrigerant fluid flowing along a first fluid circuit of a refrigerant fluid circuit of the sealed vapor compression system.

For instance, as shown best in FIG. 3, multiway valve 280 can be moved or switched to the first open position to allow refrigerant fluid to flow from vapor outlet 274 of flash tank 270 to the inlet 212 of compressor 210 along first supply conduit 292 and delivery conduit 296. Thus, refrigerant fluid circuit 202 has a first fluid circuit 204 in which refrigerant fluid can be transmitted through sealed system 200. When multiway valve 280 is in the first open position, the inlet 212 of compressor 210 has a first suction pressure SP1 that is associated with the first outlet pressure P1 output by first evaporator 240.

Figure 4:
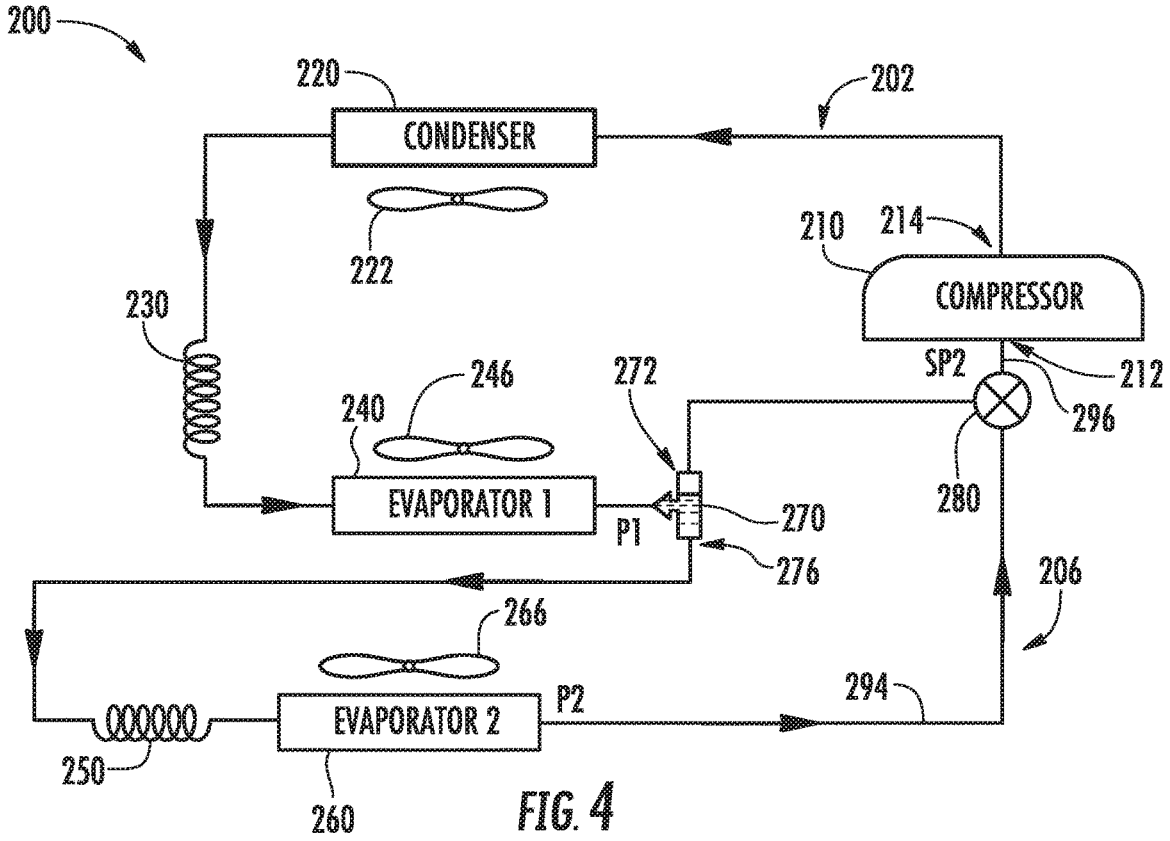
FIG. 4 provides yet another schematic view of the sealed vapor compression system of FIG. 2 and depicts refrigerant fluid flowing along a second fluid circuit of the refrigerant fluid circuit of the sealed vapor compression system.

As shown best in FIG. 4, multiway valve 280 can be moved or switched to the second open position to allow refrigerant fluid to flow from liquid outlet 276 of flash tank 270 to the inlet 212 of compressor 210 along second supply conduit 294 and delivery conduit 296. Thus, refrigerant fluid circuit 202 has a second fluid circuit 206 in which refrigerant fluid can be transmitted through sealed system 200. When multiway valve 280 is in the second open position, the inlet 212 of compressor 210 has a second suction pressure SP2 that is associated with the second outlet pressure P2 output by second evaporator 260. As noted above, second evaporator 260 outputs the refrigerant fluid at a second outlet pressure P2, which is different than the first outlet pressure P1 output by first evaporator 240. Thus, the inlet 212 of compressor 210 sees differing suction pressures (e.g., SP1, SP2) depending on the valve position or refrigerant flow through multiway valve 280.

Returning to FIG. 2, sealed system 200 further includes a controller 290 communicatively coupled with the one or more valves, and particularly for this embodiment, multiway valve 280. Controller 290 can be communicatively coupled with multiway valve 280 by any suitable wired and/or wireless connection. Controller 290 can be communicatively coupled with other components of sealed system 200, including compressor 210 and first and second evaporator fans 246, 266 (or motors operatively coupled thereto for driving first and second evaporator fans 246, 266) and condenser fan 222 (or a motor operatively coupled thereto for driving condenser fan 222). In some embodiments, controller 290 can control or activate first evaporator fan 246 to move air across first evaporator 240 and second evaporator fan 266 to move air across second evaporator 260 continuously throughout operation of compressor 210. That is, controller 290 can activate first and second evaporator fans 246, 266 to move air across their respective first and second evaporators 240, 260 continuously during the valve switching operation as long as compressor 210 is running.

In some embodiments, controller 290 includes one or more processor(s) and one or more memory device(s). The processor(s) of controller 290 can be any suitable processing device, such as a microprocessor, microcontroller, integrated circuit, or other suitable processing device. The memory device(s) of controller 290 can include any suitable computing system or media, including, but not limited to, non-transitory computer-readable media, RAM, ROM, hard drives, flash drives, or other memory devices. The memory of controller can store information accessible by processor(s) of controller 290, including instructions that can be executed by processor(s) of controller 290 in order to provide functionality to sealed system 200. For instance, controller 290 can execute one or more software applications or control logic for certain functionality operations.

For example, in some embodiments, controller 290 is configured to switch the one or more valves to selectively switch the refrigerant flow to the inlet 212 of compressor 210 between: i) the vapor outlet 274 of flash tank 270 and the inlet 212 of compressor 210, and ii) the liquid outlet 276 of flash tank 270 and the inlet 212 of compressor 210. Particularly, for this embodiment, controller 290 is configured to switch multiway valve 280 between the first open position to flow refrigerant fluid from the vapor outlet 274 of flash tank 270 and the inlet 212 of compressor 210 and the second open position to flow refrigerant fluid from the liquid outlet 276 of flash tank 270 and the inlet 212 of compressor 210 during operation of compressor 210. As will be explained further below, controller 290 can control multiway valve 280 to switch between the first open position and the second open position (or additional open positions) relatively frequently (e.g., every couple, few, or several seconds depending on the heat load applied on the sealed system). In some example embodiments, the one or more valves (e.g., multiway valve 280) have a response time of five hundred milliseconds (500 ms) or less. For instance, in some embodiments, multiway valve 280 can move between positions within five hundred milliseconds (500 ms) or less when commanded to do so, e.g., by controller 290.

Figure 5:
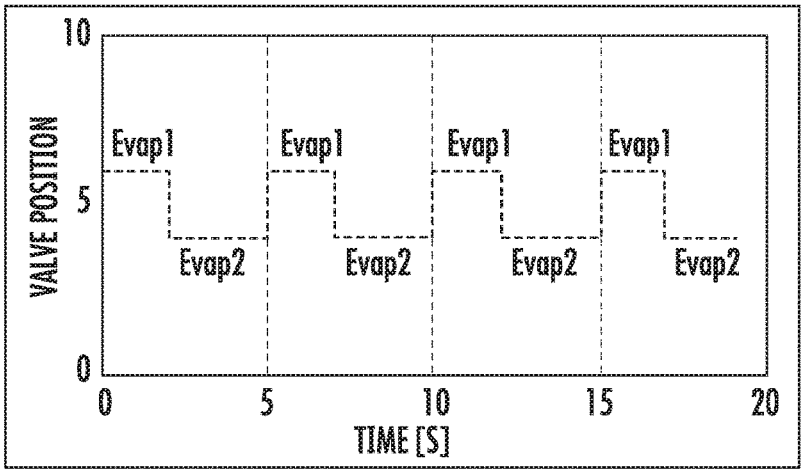
FIG. 5 provides a graph depicting the position of multi-way valve as a function of time according to an example embodiment of the present subject matter.

FIG. 5 provides a graph depicting the position of multiway valve 280 as a function of time according to an example embodiment of the present subject matter. As shown in FIG. 5, for this example embodiment, multiway valve 280 is switched between the first open position and the second open position every two (2) or three (3) seconds during operation of compressor 210. Particularly, multiway valve 280 is positioned or switched to the first open position to flow refrigerant fluid from the vapor outlet 274 of flash tank 270 and the inlet 212 of compressor 210 for two (2) seconds (e.g., as shown in FIG. 3) and then switched to the second open position to flow refrigerant fluid from the liquid outlet 276 of flash tank 270 and the inlet 212 of compressor 210 for three (3) seconds (e.g., as shown in FIG. 4). Multiway valve 280 is then switched back and forth between the first and second open positions in the same or similar manner during operation of compressor 210. In some embodiments, multiway valve 280 can be switched back and forth between the first and second open positions in the same or similar manner for the entire duration of operation of compressor 210.

Multiway valve 280 is selectively switched between the first position and the second position to switch the refrigerant flow to the inlet 212 of the compressor 210 such that a temperature increase in first evaporator 240 and second evaporator 260 is a negligible increase. The temperature increase is negligible due at least in part due to the thermal inertia from the thermal capacity of the evaporator material of first and second evaporators 240, 260, and the presence of some liquid refrigerant in the "off" evaporator. In some embodiments, the thermal response of an evaporator can be slowed by an evaporator fan moving air over the "off" evaporator. Stated another way, when multiway valve 280 switches the flow to compressor 210, the thermal inertia or slow thermal response time of the "off" evaporator prevents the "off" evaporator from increasing in temperature. The thermal inertia prevents the "off" evaporator from increasing in temperature but only for a relatively short period of time. Accordingly, in accordance with example aspects of the present disclosure, the previously "off" evaporator is switched "on" and the previously "on" evaporator is switched "off" The relatively frequent switching of multiway valve 280 allows for sealed system 200 to provide cooling using multiple evaporators at different pressures whilst effectively operating in a sequential manner using a single compressor, among other benefits.

In some embodiments, a negligible increase in the temperature increase in first evaporator 240 and second evaporator 260 is less than about five tenths of a degree Fahrenheit (0.5° F.). In yet other embodiments, a negligible increase in the temperature increase in first evaporator 240 and second evaporator 260 is equal to or less than about two degrees Fahrenheit (2° F.).

Figure 6:
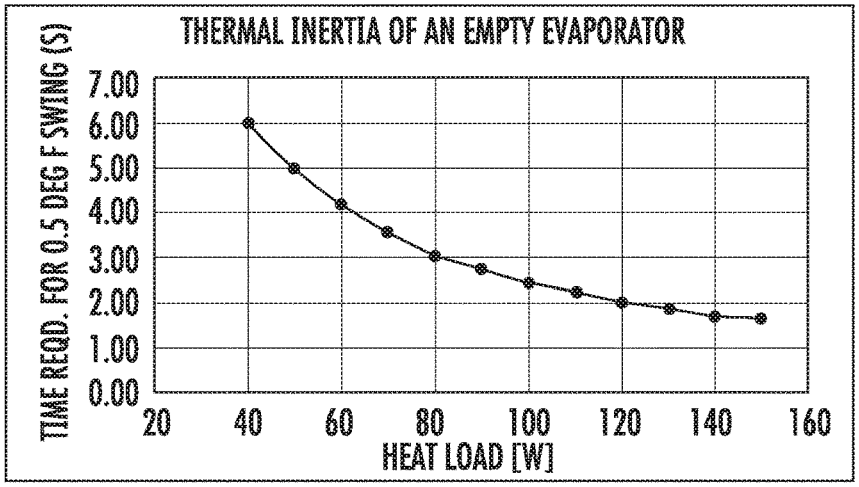
FIG. 6 provides a graphical depiction of the thermal inertia of an empty evaporator as a function of time according to an example embodiment of the present subject matter.

FIG. 6 provides a graphical depiction of the thermal inertia of an empty evaporator as a function of time according to an example embodiment of the present subject matter. Particularly, FIG. 6 depicts a time required for an evaporator to change in temperature by five tenths of a degree Fahrenheit (0.5° F.) as a function of time according to an example embodiment of the present subject matter. As shown in FIG. 6, the greater the heat load on an evaporator, the less time that is required for the evaporator to change temperature by 0.5° F. In contrast, the smaller the heat load on an evaporator, the more time that is required for the evaporator to change temperature by 0.5° F. Accordingly, in order to maintain a negligible increase in the first and second evaporators 240, 260 multiway valve 280 is selectively switched between the first position and the second position to selectively switch the refrigerant flow to the inlet 212 of compressor 210 at a frequency based at least in part on a heat load applied on first evaporator 240 and second evaporator 260.

In some embodiments, multiway valve 280 selectively switches the refrigerant flow to the inlet 212 of compressor 210 at least as frequently as every six (6) seconds during operation of compressor 210. That is, multiway valve 280 selectively switches the refrigerant flow to the inlet 212 of compressor 210 every six (6) seconds or less during operation of compressor 210. For instance, in one example, if the heat load on first evaporator 240 is forty watts (40 W) and the heat load on second evaporator 260 is forty watts (40 W), multiway valve 280 can be switched between the first and second positions at least as frequently as every six (6) seconds during operation of compressor 210. In this way, neither the first evaporator 240 nor the second evaporator 260 will increase in temperature beyond a negligible increase (e.g., where a negligible increase corresponds to a change in evaporator temperature of 0.5° F.). In yet other embodiments, multiway valve 280 selectively switches the refrigerant flow to the inlet 212 of compressor 210 at least as frequently as every twelve (12) seconds during operation of compressor 210.

In another example, if the heat load on first evaporator 240 is eighty watts (80 W) and the heat load on second evaporator 260 is one hundred twenty watts (120 W), the multiway valve 280 can be switched to the first position to flow refrigerant from the vapor outlet 272 of flash tank 270 to inlet of compressor 210 for about two (2) seconds before second evaporator 260 increases in temperature of 0.5° F. To prevent second evaporator 260 from increasing in temperature more than a negligible amount (e.g., by 0.5° F.), multiway valve 280 is switched to the second position to flow refrigerant from the liquid outlet 274 of flash tank 270, through second expansion device 250 and second evaporator 260, and to inlet of compressor 210. Multiway valve 280 holds the second position for about three (3) seconds before first evaporator 240 increases in temperature of 0.5° F. To prevent first evaporator 240 from increasing in temperature more than a negligible amount (e.g., by 0.5° F.), multiway valve 280 is switched back again to the first position. This frequent switching operation can continue continuously for the duration of operation of compressor 210. In this way, neither the first evaporator 240 nor the second evaporator 260 will increase in temperature beyond a negligible increase (e.g., where a negligible increase corresponds to a change in evaporator temperature of 0.5° F. and greater overall efficiency in sealed system 200 can be achieved).

In some embodiments, one or more sensors communicatively with controller 290 can be positioned within the space to be conditioned, such as e.g., chilled chambers 104, 108 of refrigerator appliance 100. The sensors can sense or measure various parameters indicative of the conditions within the space to be conditioned. For instances, the one or more sensors can measure the temperature, humidity, etc. of the space to be conditioned. Controller 290 can receive, from the one or more sensors, signals indicative of the parameters that describe the conditions within the space to be conditioned. Based on such signals, as well as other inputs (e.g., the volume of the space to be conditioned, which may be known), controller 290 can calculate the heat load on first evaporator 240 and second evaporator 260, e.g., in real time. Accordingly, the switching frequency of multiway valve 280 can be adjusted in accordance with the calculated heat loads.

Figure 7:
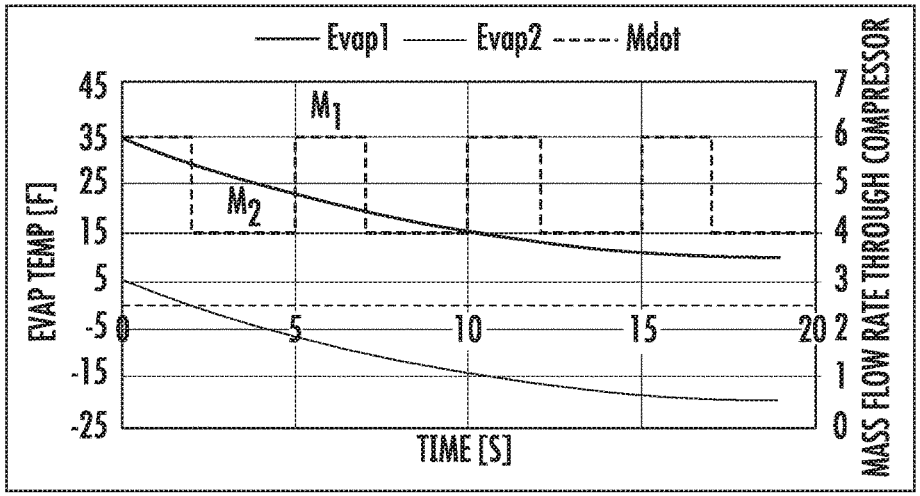
FIG. 7 provides a chart depicting a mass flow through a compressor of sealed system and evaporator temperatures as a function of time during a valve switching operation according to an example embodiment of the present subject matter.

FIG. 7 provides a chart depicting a mass flow through compressor 210 and evaporator temperatures as a function of time during a valve switching operation according to an example embodiment of the present subject matter. As shown, the temperature of first evaporator 240, labeled "EVAP 1" is not affected by the relatively frequent switching of multiway valve 280 and resultant mass flow changes through compressor 210. Likewise, the temperature of second evaporator 260, labeled "EVAP 2" is not affected by the relatively frequent switching of multiway valve 280 and resultant mass flow changes through compressor 210. Accordingly, the fast and relatively frequent valve switching operation of the sealed system 200 enables the implementation of advanced energy efficient multistage cycles on a system with a single compressor and no ejectors. Indeed, such system can achieve more than a ten percent (10%) increase in efficiency over conventional systems. The energy efficiency of these multistage cycles arises from various factors, including higher evaporation temperatures, higher cooling capacity of second evaporator 260 due to application of flash tank 270, lower cycle losses, and higher compression efficiency than conventional systems due to less superheat. For refrigerator appliances, higher evaporation temperatures can provide higher humidity levels in the chilled chambers, which may improve food preservation. Further, simultaneous multi-stage cycles allows for matching the runtimes in every chilled chamber by adjusting the cooling capacities of the evaporators, e.g., by adjusting the switching timing of multiway valve 280. Such systems can be tuned to provide negligible temperature swings in the chilled chambers, especially when the refrigeration appliance has multiple chambers with different temperature settings. In addition, ice maker cooling capacity can also be improved since it is possible to extend the runtime of the evaporator dedicated to cooling the freezer chamber without affecting efficiency. Accordingly, overall, sealed system 200 provides a multistage vapor compression system that can achieve simultaneous cooling of multiple evaporators at multiple low side pressures.

Figure 8:
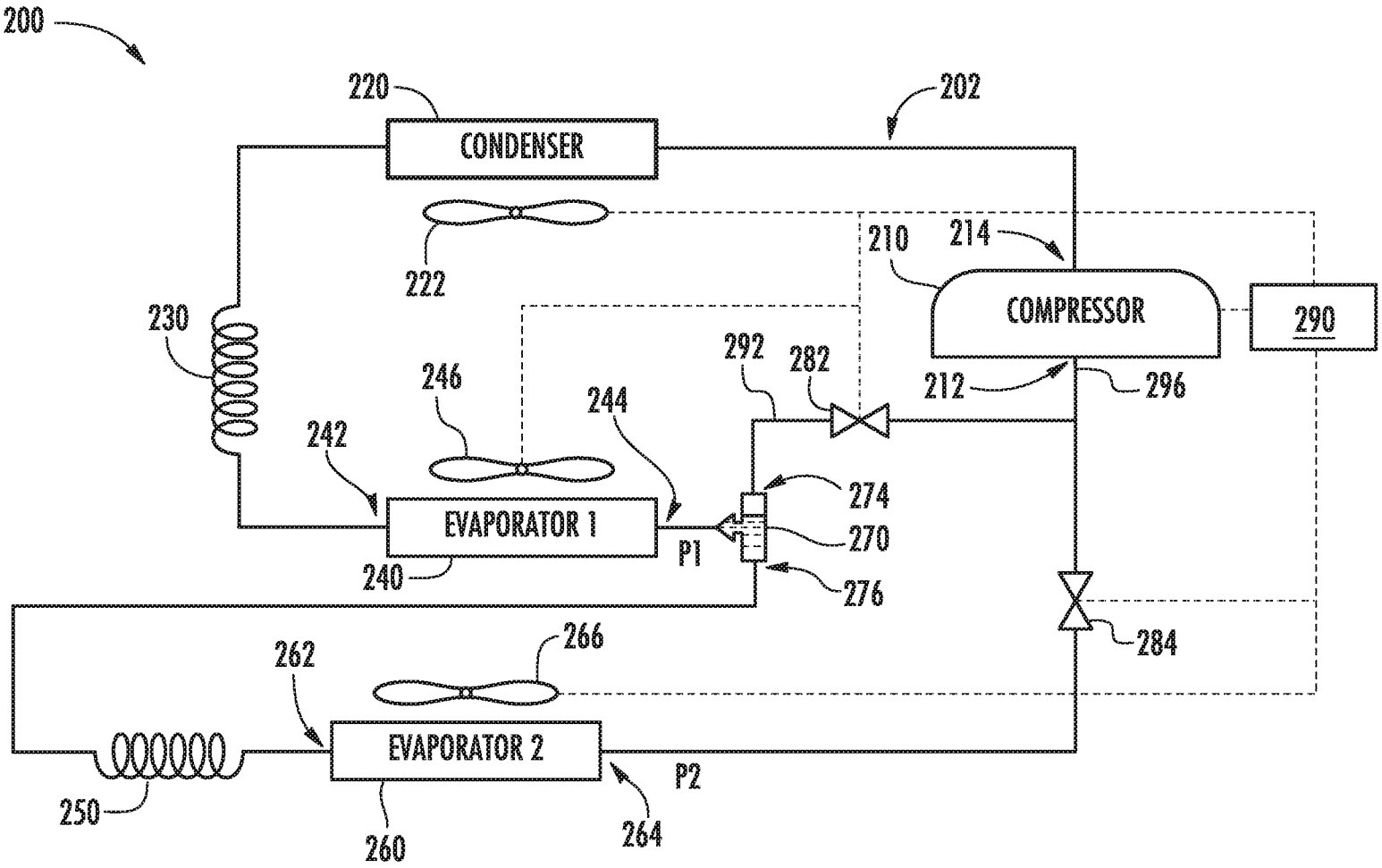
FIG. 8 provides a schematic view of another sealed vapor compression system for an appliance according to an example embodiment of the present subject matter.

FIG. 8 provides a schematic view of another sealed vapor compression system 200 for an appliance according to an example embodiment of the present subject matter. The sealed system 200 of FIG. 8 functions and is configured in substantially the same manner as the sealed system of FIG. 2, except as provided below.

For the depicted embodiment of FIG. 8, the one or more valves of sealed system 200 include a first valve 282 and a second valve 284. First valve 282 is positioned along first supply conduit 292. For this embodiment, first valve 282 is fluidly coupled with vapor outlet 272 of flash tank 270 and the inlet 212 of compressor 210. Second valve 284 is positioned along second supply conduit 294. Second valve 284 is fluidly coupled with the outlet side 264 of second evaporator 260 and the inlet 212 of compressor 210. First valve 282 and second valve 284 can each be "ON/OFF" valves, such as e.g., solenoid valves. In some embodiments, first valve 282 and second valve 284 can each be or check valves, such as e.g., nozzle check valves.

Controller 290 is communicatively coupled with first valve 282 and second valve 284, e.g., via any suitable wired or wireless connection. For this embodiment, controller 290 is configured to switch first valve 282 between an open position and a closed position and second valve 284 between an open position and a closed position. Particularly, controller 290 is configured to switch first valve 282 between the open position and the closed position and second valve 284 between the open position and the closed position such that when: i) first valve 282 is switched to the open position, second valve 284 is switched to the closed position; and ii) first valve 282 is switched to the closed position, second valve 284 is switched to the open position. In this way, when first valve 282 is switched to the open position and second valve 284 is switched to the closed position, refrigerant fluid can flow from vapor outlet 272 of flash tank 270 to the inlet 212 of compressor 210 for a first period of time (e.g., two (2) seconds) and refrigerant fluid is prevented from flowing from liquid outlet 274 of flash tank 270 to the inlet 212 of compressor 210 for the first period of time. And when first valve 282 is switched to the closed position and second valve 284 is switched to the open position, refrigerant fluid can flow from flowing from liquid outlet 274 of flash tank 270 to the inlet 212 of compressor 210 for a second period of time (e.g., three (3) seconds) and refrigerant fluid is prevented from flowing from vapor outlet 272 of flash tank 270 to the inlet 212 of compressor 210 for the second period of time. Thus, first and second valves 282, 284 can be frequently selectively switched between their respective open and closed positions so that refrigerant fluid can selectively flow along a first fluid circuit 204 (see FIG. 3) and second fluid circuit 206 (see FIG. 4). The first and second valves 282, 284 can be switched at a frequency such that the temperature increase in first evaporator 240 and second evaporator 260 is a negligible increase (e.g., less than two degrees Fahrenheit (2° F.)). Moreover, first and second valves 282, 284 can be fast switching valves. For instance, in some embodiments, first and second valves 282, 284 can move between their respective open and closed positions within five hundred milliseconds (500 ms) or less when commanded to do so, e.g., by controller 290.

Figure 9:
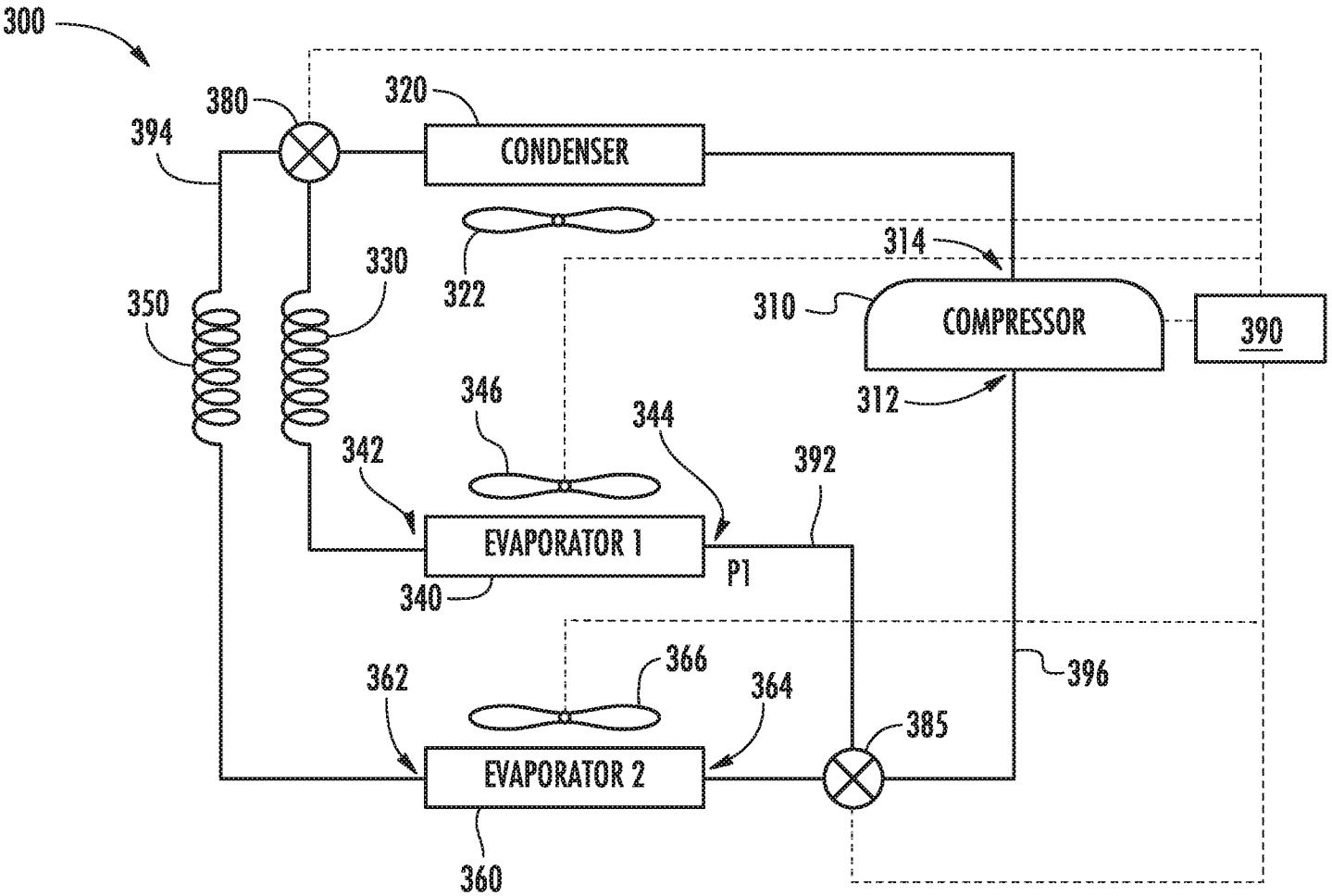
FIG. 9 provides a schematic view of a sealed vapor compression system having multiple evaporators fluidly coupled in parallel according to an example embodiment of the present subject matter.

FIG. 9 provides a schematic view of a sealed vapor compression system 300 having multiple evaporators fluidly coupled in parallel according to an example embodiment of the present subject matter. The sealed system 300 of FIG. 9 functions and is configured in a similar manner as the sealed systems described above having multiple evaporators fluidly coupled in series, except as provided below.

As shown in FIG. 9, sealed system 300 includes a compressor 310 having an inlet 312 and an outlet 314. Sealed system 300 also includes a condenser 320 fluidly coupled with the outlet 314 of compressor 310 and operable to receive compressed refrigerant fluid from compressor 310. Moreover, for this embodiment, a condenser fan 322 is operable to move air across condenser 320 so as to provide forced convection for a more rapid and efficient heat exchange between the refrigerant fluid within condenser 320 and the ambient air.

Sealed system 300 also includes a first conduit 392 and a second conduit 394. A first evaporator 340 is fluidly coupled with condenser 320 and is positioned along first conduit 392. A first expansion device 330 is positioned along first conduit 392 upstream of first evaporator 340. First evaporator 340 is fluidly connected with an outlet of first expansion device 330. First evaporator 340 has an inlet side 342 and an outlet side 344. First evaporator 340 is operable to receive refrigerant fluid at the inlet side 342 and operable to output refrigerant fluid at outlet side 344 at a first outlet pressure P1. Specifically, upon exiting first expansion device 330 and entering first evaporator 340, the refrigerant fluid in a generally liquid state drops in pressure and temperature. Due to the pressure drop and phase change of the refrigerant fluid from a generally liquid state to a generally vapor state, first evaporator 340 is cool relative to the space to be conditioned, such as e.g., chilled chambers 104, 108 of refrigerator appliance 100 (FIG. 1). As such, cooled air is produced and refrigerates the space to be conditioned. For this embodiment, a first evaporator fan 346 is operable to move air across first evaporator 340 so as to provide forced convection to more efficiently move conditioned air, e.g., into a chilled chamber of a refrigerator appliance.

A second evaporator 360 is positioned along second conduit 394 and is fluidly coupled with first evaporator 340 in parallel as shown in FIG. 9. Moreover, second evaporator 360 is fluidly coupled with condenser 320. A second expansion device 350 is positioned along second conduit 394 upstream of second evaporator 360. Second evaporator 360 is fluidly connected with an outlet of second expansion device 350. Second evaporator 360 has an inlet side 362 and an outlet side 364. Second evaporator 360 is operable to receive refrigerant fluid at the inlet side 362 and operable to output refrigerant fluid at outlet side 364 at a second outlet pressure P2 that is different than the first outlet pressure P1 output by first evaporator 340. Specifically, upon exiting second expansion device 350 and entering second evaporator 360, the refrigerant fluid in a generally liquid state drops in pressure and temperature. Due to the pressure drop and phase change of the refrigerant fluid from a generally liquid state to a generally vapor state, second evaporator 360 is cool relative to the space to be conditioned, such as e.g., chilled chambers 104, 108 of refrigerator appliance 100 (FIG. 1). As such, cooled air is produced and refrigerates the space to be conditioned. For this embodiment, a second evaporator fan 366 is operable to move air across second evaporator 360 so as to provide forced convection to more efficiently move conditioned air, e.g., into a chilled chamber of a refrigerator appliance. Although two evaporators are shown in parallel in FIG. 9, in other example embodiments, sealed system 300 can include more than two (2) evaporators fluidly coupled in parallel.

As further depicted in FIG. 9, sealed system 300 includes one or more upstream valves positioned downstream of condenser 320 and upstream of first evaporator 340 and second evaporator 360. For this embodiment, the one or more upstream valves include a multiway valve 380 fluidly coupled with condenser 320, first conduit 392, and second conduit 394. More particularly, multiway valve 380 is fluidly connected with an outlet of condenser 320, an inlet of first expansion device 330 via first conduit 392, and an inlet of second expansion device 350. Multiway valve 380 is movable or switchable between a first open position and a second open position. In some embodiments, multiway valve 380 is movable or switchable to a closed position as well. Multiway valve 380 is operable to selectively allow a refrigerant flow along at least one of i) the first conduit 392, and ii) the second conduit 394. For instance, when multiway valve 380 is moved to the first open position, multiway valve 380 selectively allows refrigerant fluid to flow from the outlet of condenser 320 to first conduit 392 and prevents refrigerant fluid from flowing from the outlet of condenser 320 to second conduit 394. When multiway valve 380 is moved to the second open position, multiway valve 380 selectively allows a refrigerant fluid to flow from the outlet of condenser 320 to second conduit 394 and prevents refrigerant fluid from flowing from the outlet of condenser 320 to first conduit 392. Accordingly, multiway valve 380 is operable to switch the flow of refrigerant flow through sealed system 300 between first conduit 392 and second conduit 394. In alternative embodiments in which sealed system 300 includes more than two (2) evaporators fluidly coupled in parallel and positioned along their respective conduits, multiway valve 380 is operable to selectively allow a refrigerant flow along at least one of i) the first conduit 392, ii) the second conduit 394, and iii) the other conduits along which the other evaporators are positioned.

Sealed system 300 also includes one or more downstream valves positioned downstream of first evaporator 340 and second evaporator 360 and upstream of the inlet 312 of compressor 310. For this embodiment, the one or more downstream valves include a multiway valve 385 fluidly coupled with first conduit 392, second conduit 394, and the inlet 312 of compressor 310. More particularly, multiway valve 385 is fluidly connected with the outlet side 344 of first evaporator 340 via first conduit 392, the outlet side 364 of second evaporator 360, and the inlet 312 of compressor 310. Multiway valve 385 is movable or switchable between a first open position and a second open position. In some embodiments, multiway valve 385 is movable or switchable to a closed position as well. Multiway valve 385 is operable to selectively switch the refrigerant flow to the inlet 312 of compressor 310 between: i) the first conduit 392 and the inlet 312 of the compressor 310, and ii) the second conduit 394 and the inlet 312 of compressor 320. For instance, when multiway valve 385 is moved to the first open position, multiway valve 385 selectively allows refrigerant fluid to flow from first conduit 392 to the inlet 312 of compressor 310 and prevents refrigerant fluid from flowing from second conduit 394 to the inlet 312 of compressor 310. When multiway valve 385 is moved to the second open position, multiway valve 385 selectively allows refrigerant fluid to flow from second conduit 394 to the inlet 312 of compressor 310 and prevents refrigerant fluid from flowing from first conduit 392 to the inlet 312 of compressor 310. Accordingly, multiway valve 380 is operable to selectively switch the flow of refrigerant flow to compressor 310.

Controller 390 is communicatively coupled with multiway valve 380 and multiway valve 385, e.g., via any suitable wired or wireless connection. For this embodiment, controller 390 is configured to switch multiway valve 380 between the first and second open positions and multiway valve 385 between the first and second open positions. Particularly, controller 390 is configured to switch multiway valve 380 between the first and second open positions and multiway valve 385 between the first and second open positions such that when: i) multiway valve 380 is switched to the first open position, multiway valve 385 is switched to the first open position, and ii) multiway valve 380 is switched to the second open position, multiway valve 385 is switched to the second open position. Controller 390 can switch the multiway valves 380, 385 in accordance with the control scheme above and at a frequency such that the temperature increase in first evaporator 340 and second evaporator 360 is a negligible increase (e.g., less than two degrees Fahrenheit (2° F.)). In some embodiments, multiway valve 385 selectively switches the refrigerant flow to the inlet 312 of compressor 310 at least as frequently as every twelve (12) seconds during operation of compressor 310. In yet other embodiments, multiway valve 385 selectively switches the refrigerant flow to the inlet 312 of compressor 310 at least as frequently as every six (6) seconds during operation of compressor 310. Moreover, multiway valves 380, 385 can be fast switching valves. For instance, in some embodiments, multiway valves 380, 385 can move between their respective open positions within five hundred milliseconds (500 ms) or less when commanded to do so, e.g., by controller 390.

In some embodiments, the multiway valves 380, 385 can be switched to their respective open positions at the same time. For instance, multiway valve 380 and multiway valve 385 can both be switched to their respective first positions at the same time and controlled to remain open for a first predetermined time (e.g., two (2) seconds). This allows refrigerant fluid to flow from condenser 320 along first conduit 392, through first expansion device 330 and first evaporator 340, and to the inlet 312 of compressor 310. The inlet 312 of compressor 310 sees a suction pressure associated with the first outlet pressure P1 output at the outlet side 346 of first evaporator 340. Then, multiway valve 380 and multiway valve 385 can both be switched to their respective second positions at the same time and controlled to remain open for a second predetermined time (e.g., three (3) seconds). This allows refrigerant fluid to flow from condenser 320 along second conduit 394, through second expansion device 350 and second evaporator 360, and to the inlet 312 of compressor 310. The inlet 312 of compressor 310 sees a suction pressure associated with the second outlet pressure P2 output at the outlet side 366 of second evaporator 360. This switching operation can continue for the duration of operation of compressor 310. Thus, multiway valve 380 and multiway valve 385 can be frequently selectively switched (e.g., on the order of seconds) to their respective positions at the same time during operation of the compressor 310.

In some alternative embodiments, the multiway valves 380, 385 can be switched at offset times. For instance, to flow refrigerant fluid along first conduit 392 to compressor 310, multiway valve 380 can be switched to the first open position at a first time and multiway valve 385 can be switched to the first open position at a second time that is later in time than the first time. Then, to flow refrigerant fluid along second conduit 394 to compressor 310, multiway valve 380 can be switched to the second open position at a first time and multiway valve 385 can be switched to the second open position at a second time that is later in time than the first time. The timing offset between the opening of the multiway valves 380, 385 to their respective open positions can depend on the compressor used, the type of refrigerant used, the length of the fluid conduits of sealed system 300, and other parameters that affect the mass flow rate of the refrigerant fluid through sealed system 300.

Positioning multiway valve 380 upstream of first evaporator 340 and second evaporator 360 provides a number of advantages over sealed systems that do not include such a control device upstream of the fluidly coupled first and second evaporators 340, 360. For instance, positioning multiway valve 380 upstream of first evaporator 340 and second evaporator 360 can prevent a decrease in mass flow of the refrigerant fluid through the "on" evaporator and compressor 310 and thus is not subject to efficiency penalties experienced by systems without one or more valves positioned upstream of first evaporator 340 and second evaporator 360. Stated differently, if sealed system 300 did not include multiway valve 380 upstream of first evaporator 340 and second evaporator 360, then refrigerant fluid would flow from condenser 320 into both first and second conduits 392, 394 and first and second evaporators 340, 360 regardless of the position of multiway valve 385 positioned downstream of first and second evaporators 340, 360. Thus, there would be less mass flow of the refrigerant fluid through the "on" evaporator as well as compressor 310. Accordingly, sealed systems without one or more valves positioned upstream of the evaporators have reduced mass flow rates of refrigerant fluid through the "on" evaporator and compressor, and consequently, the "on" evaporator has less cooling capacity and the overall sealed system is less efficient overall.

FIGS. 10 through 14 provide schematic views of other sealed vapor compression systems 300 having multiple evaporators fluidly coupled in parallel according to example embodiments of the present subject matter. The sealed systems 300 depicted in FIGS. 10 through 14 function and are configured in substantially the same manner as the sealed system of FIG. 9, except as provided below.

Figure 10:
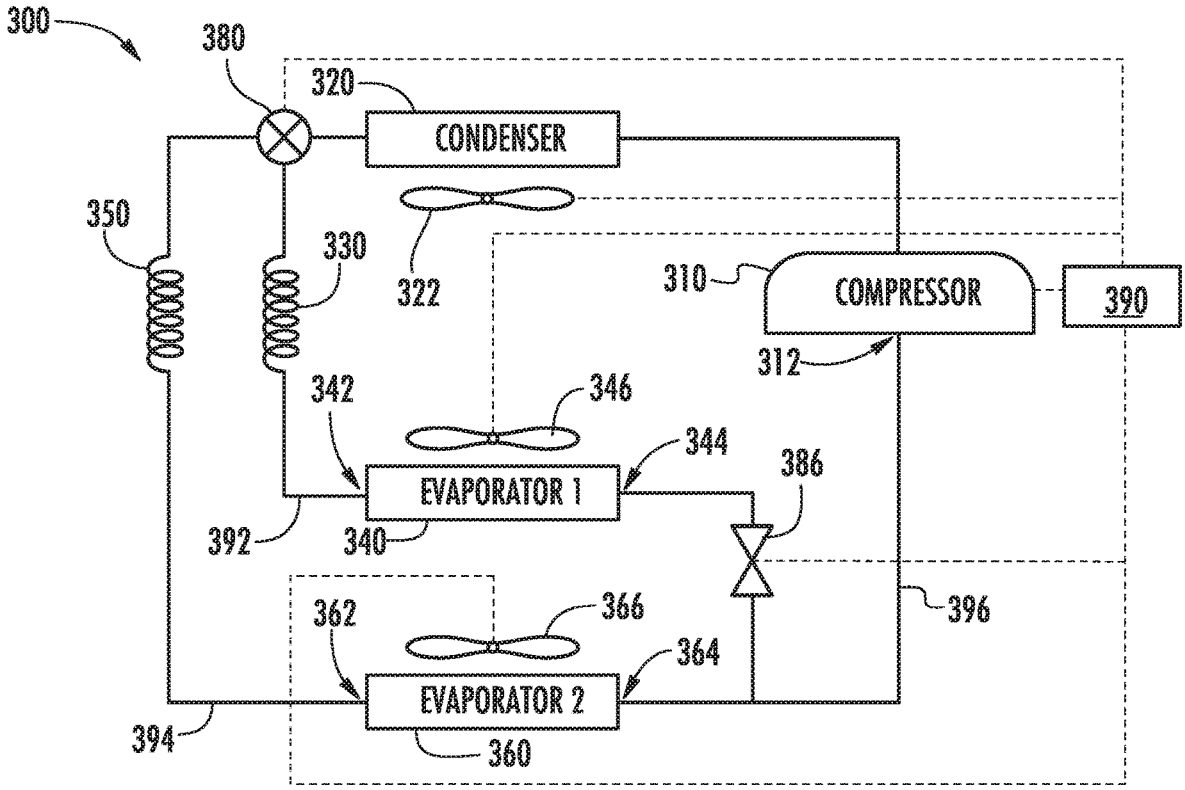
FIGS. 10 through 14 provide schematic views of other sealed vapor compression systems having multiple evaporators fluidly coupled in parallel according to example embodiments of the present subject matter.

As shown in FIG. 10, in some embodiments, instead of multiway valve 385 (FIG. 9), the one or more downstream valves of sealed system 300 can include a first downstream valve 386 positioned along first conduit 392 downstream of first evaporator 340. First downstream valve 386 can be an "ON/OFF" valve, such as e.g., a solenoid valve. In some embodiments, first downstream valve 386 can be a check valve, such as e.g., a nozzle check valve.

First downstream valve 386 can be selectively switched (e.g., by controller 390) in coordination with multiway valve 380 to selectively switch the refrigerant flow to the inlet 312 of compressor 310 between: i) first conduit 392 and the inlet 312 of compressor 310, and ii) second conduit 394 and the inlet 312 of compressor 310, wherein, in coordination, multiway valve 380 and first downstream valve 386 selectively switch the flow of the refrigerant fluid to the inlet 312 of compressor 310 at a frequency such that the temperature increase in first evaporator 340 and second evaporator 360 is negligible during the switching operation of first downstream valve 386 and upstream multiway valve 380. In some alternative embodiments, instead of multiway valve 385 (FIG. 9), the one or more downstream valves of sealed system 300 can include a second downstream valve (not shown) positioned along second conduit 394 downstream of second evaporator 360.

Figure 11:
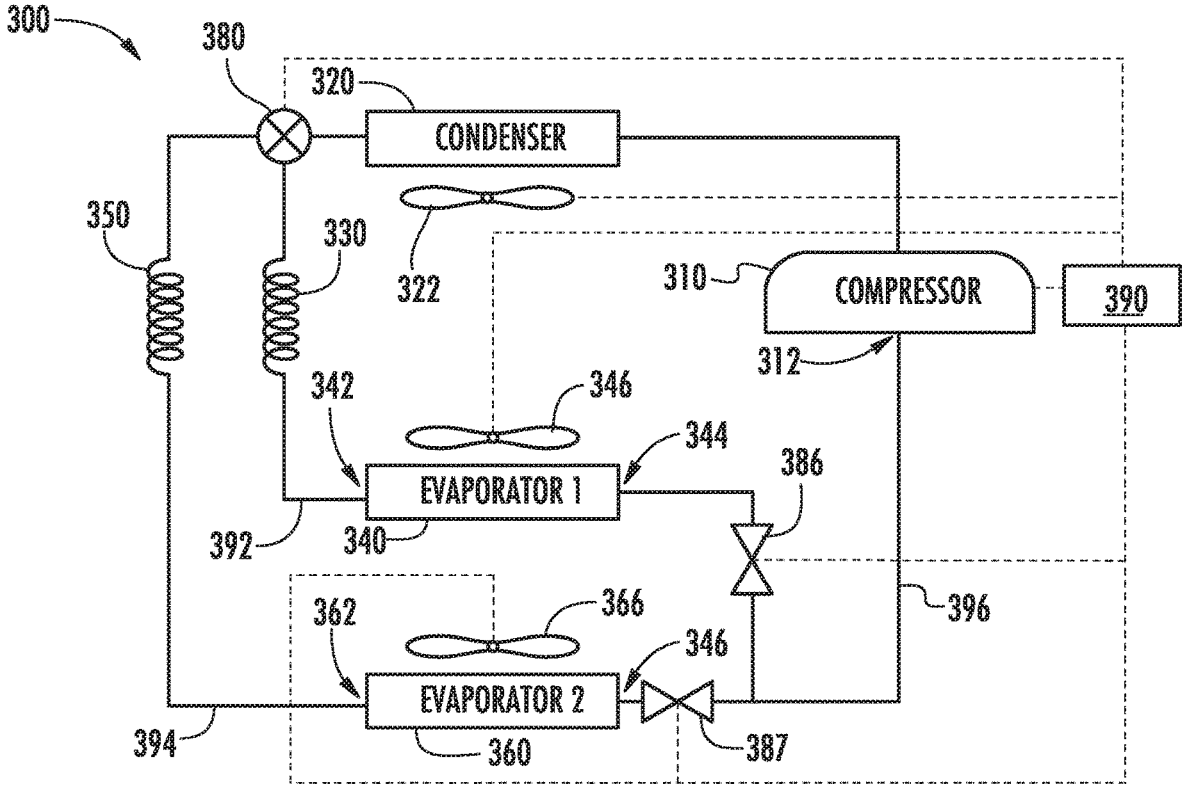

As shown in FIG. 11, in some embodiments, instead of multiway valve 385 (FIG. 9), the one or more downstream valves of sealed system 300 can include a first downstream valve 386 positioned along first conduit 392 downstream of first evaporator 340 and a second downstream valve 387 positioned along second conduit 394 downstream of second evaporator 360. First downstream valve 386 and second downstream valve 387 can both be "ON/OFF" valves, such as e.g., solenoid valves. In some embodiments, first downstream valve 386 and second downstream valve 387 can be check valves, such as e.g., nozzle check valves.

First downstream valve 386 and second downstream valve 387 can be selectively switched (e.g., by controller 390) in coordination with multiway valve 380 to selectively switch the refrigerant flow to the inlet 312 of compressor 310 between: i) first conduit 392 and the inlet 312 of compressor 310, and ii) second conduit 394 and the inlet 312 of compressor 310. In such embodiments, in coordination, multiway valve 380, first downstream valve 386, and second downstream valve 387 selectively switch the flow of the refrigerant fluid to the inlet 312 of compressor 310 at a frequency such that the temperature increase in first evaporator 340 and second evaporator 360 is negligible during the switching operation of first downstream valve 386 and upstream multiway valve 380.

Figure 12:
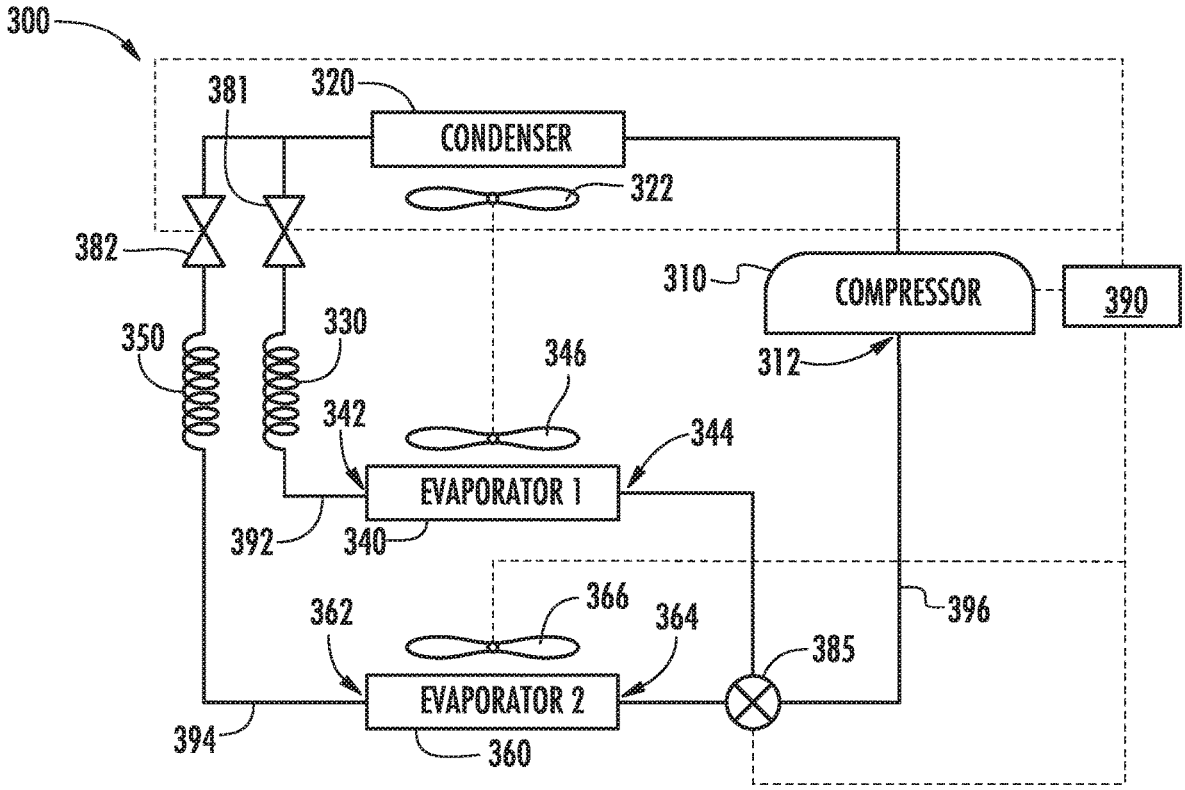

As shown in FIG. 12, in some embodiments, instead of multiway valve 380 (FIG. 9), the one or more upstream valves of sealed system 300 can include a first upstream valve 381 and a second upstream valve 382. First upstream valve 381 is positioned along first conduit upstream 392 of first evaporator 340 and second upstream valve 382 is positioned along second conduit 394 upstream of second evaporator 360. Further, the one or more downstream valves of sealed system 300 can include multiway valve 385 fluidly coupled with the first conduit 392, the second conduit 394, and the inlet 312 of compressor 310. First upstream valve 381 and second upstream valve 382 can both be "ON/OFF" valves, such as e.g., solenoid valves.

First upstream valve 381 and second upstream valve 382 can be selectively switched (e.g., by controller 390) in coordination with multiway valve 385 to selectively switch the refrigerant flow to the inlet 312 of compressor 310 between: i) first conduit 392 and the inlet 312 of compressor 310, and ii) second conduit 394 and the inlet 312 of compressor 310. In such embodiments, in coordination, first upstream valve 381, second upstream valve 382, and multiway valve 385 can selectively switch the flow of the refrigerant fluid to the inlet 312 of compressor 310 at a frequency such that the temperature increase in first evaporator 340 and second evaporator 360 is negligible during the switching operation of first upstream valve 381, second upstream valve 382, and downstream multiway valve 385.

Figure 13:
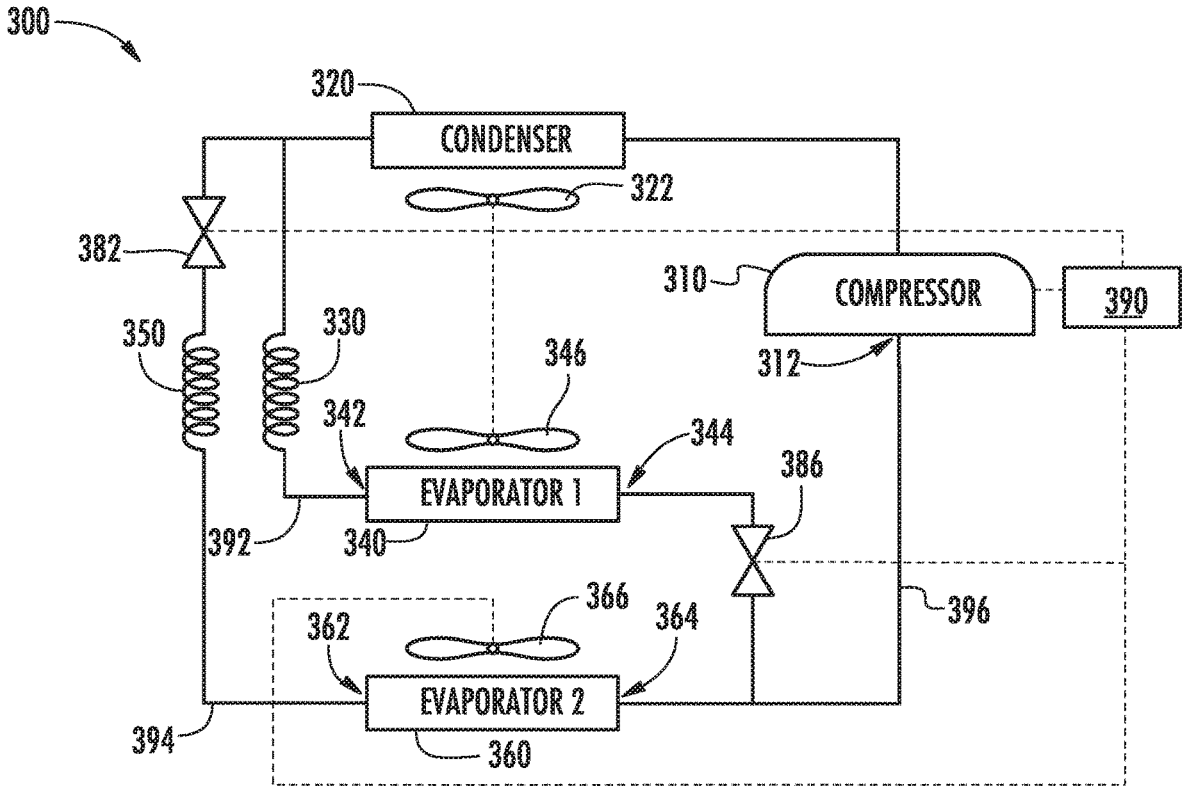

As shown in FIG. 13, in some embodiments, instead of multiway valve 380 (FIG. 9), the one or more upstream valves of sealed system 300 can include a second upstream valve 382 positioned along second conduit 394 upstream of second evaporator 360. Further, instead of multiway valve 385 (FIG. 9), the one or more downstream valves can include first downstream valve 386 positioned along first conduit 392 downstream of first evaporator 340.

Second upstream valve 382 can be selectively switched (e.g., by controller 390) in coordination with first downstream valve 386 to selectively switch the refrigerant flow to the inlet 312 of compressor 310 between: i) first conduit 392 and the inlet 312 of compressor 310, and ii) second conduit 394 and the inlet 312 of compressor 310. When second upstream valve 382 is switched to an open position, first downstream valve 386 is switched to the closed position such that second evaporator 360 is the "on" evaporator and first evaporator 340 is the "off" evaporator. In contrast, when second upstream valve 382 is switched to a closed position, first downstream valve 386 is switched to an open position such that second evaporator 360 is the "off" evaporator and first evaporator 340 is the "on" evaporator. In such embodiments, in coordination, second upstream valve 382 and first downstream valve 386 can selectively switch the flow of the refrigerant fluid to the inlet 312 of compressor 310 between the different evaporators at a frequency such that the temperature increase in first evaporator 340 and second evaporator 360 is negligible during the switching operation of second upstream valve 382 and first downstream valve 386.

In some alternative embodiments, although not shown, instead of multiway valve 380 (FIG. 9), the one or more upstream valves of sealed system 300 can include first upstream valve 381 positioned along first conduit 392 upstream of first evaporator 340. Further, instead of multiway valve 385 (FIG. 9), the one or more downstream valves can include second downstream valve 387 positioned along second conduit 394 downstream of second evaporator 360.

Figure 14:
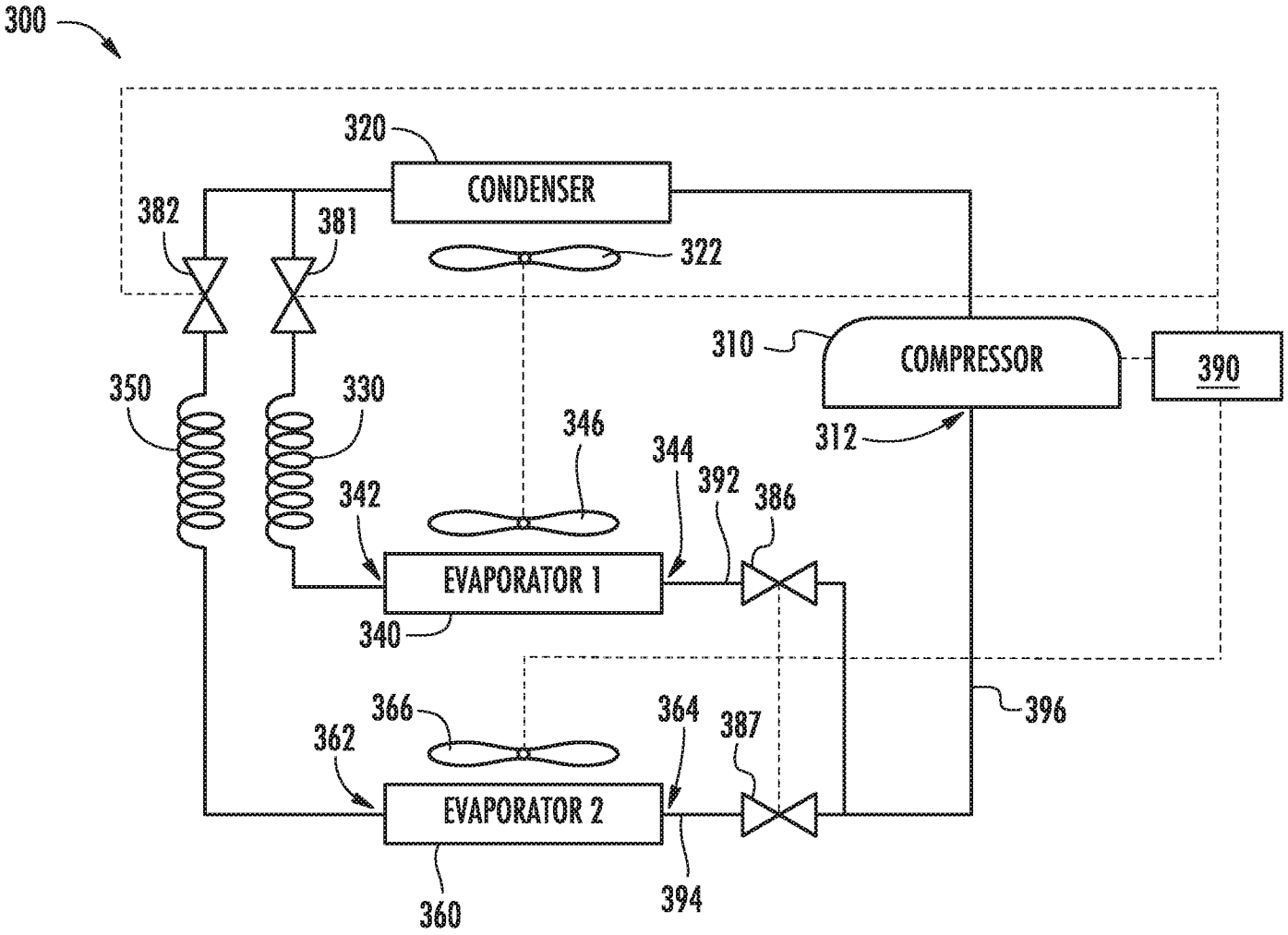

As shown in FIG. 14, in some embodiments, instead of multiway valve 380 (FIG. 9), the one or more upstream valves of sealed system 300 can include first upstream valve 381 and second upstream valve 382. First upstream valve 381 is positioned along first conduit upstream 392 of first evaporator 340 and second upstream valve 382 is positioned along second conduit 394 upstream of second evaporator 360. Further, in such embodiments, instead of multiway valve 385 (FIG. 9), the one or more downstream valves of sealed system 300 can include first downstream valve 386 positioned along first conduit 392 downstream of first evaporator 340 and second downstream valve 387 positioned along second conduit 394 downstream of second evaporator 360. Each of the valves can be "ON/OFF" valves, such as e.g., solenoid valves. In some embodiments, the downstream valves 386, 387 can be check valves, such as e.g., nozzle check valves.

First upstream valve 381 and second upstream valve 382 can be selectively switched (e.g., by controller 390) in coordination with first downstream valve 386 and second downstream valve 387 to selectively switch the refrigerant flow to the inlet 312 of compressor 310 between: i) first conduit 392 and the inlet 312 of compressor 310, and ii) second conduit 394 and the inlet 312 of compressor 310. In such embodiments, in coordination, first upstream valve 381, second upstream valve 382, first downstream valve 386, and second downstream valve 387 can selectively switch the flow of the refrigerant fluid to the inlet 312 of compressor 310 at a frequency such that the temperature increase in first evaporator 340 and second evaporator 360 is negligible during the switching operation of the valves, (e.g., a temperature increase of less than three degrees Fahrenheit (3° F.)).

Figure 15:
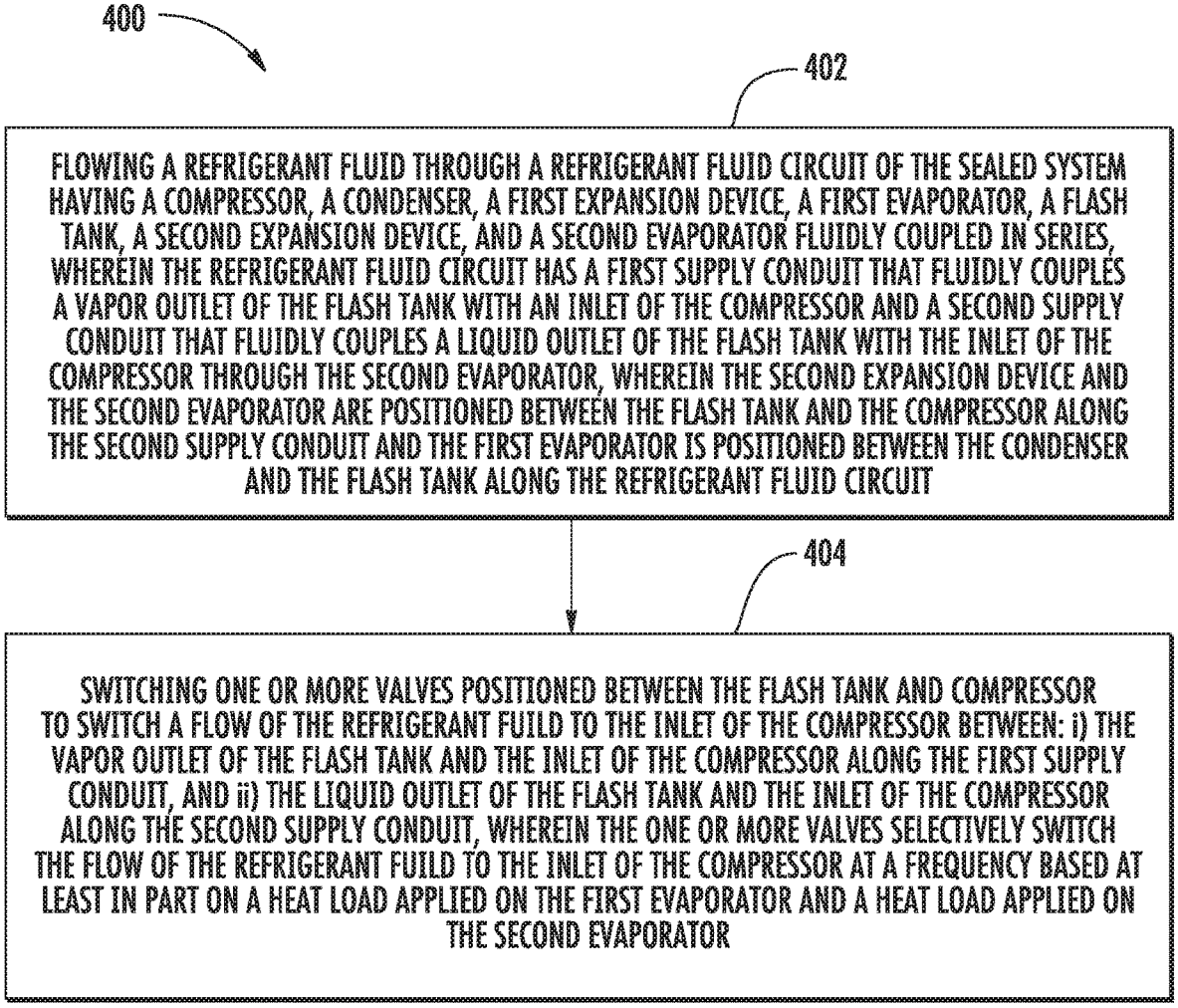
FIG. 15 provides a flow diagram of an example method for operating a sealed system of an appliance according to an example embodiment of the present subject matter.

FIG. 15 provides a flow diagram of an example method (400) for operating a sealed system of an appliance. For instance, method (400) can be employed to operate sealed system 200 described herein for any suitable appliance, such as e.g., a refrigerator appliance. In addition, FIG. 15 depicts steps performed in a particular order for purposes of illustration and discussion. Those of ordinary skill in the art, using the disclosures provided herein, will understand that the various steps of any of the methods disclosed herein can be modified, adapted, expanded, rearranged and/or omitted in various ways without deviating from the scope of the present disclosure.

At (402), the method (400) includes flowing a refrigerant fluid through a refrigerant fluid circuit of the sealed system having a compressor, a condenser, a first expansion device, a first evaporator, a flash tank, a second expansion device, and a second evaporator fluidly coupled in series, wherein the refrigerant fluid circuit has a first supply conduit that fluidly couples a vapor outlet of the flash tank with an inlet of the compressor and a second supply conduit that fluidly couples a liquid outlet of the flash tank with the inlet of the compressor through the second evaporator, wherein the second expansion device and the second evaporator are positioned between the flash tank and the compressor along the second supply conduit and the first evaporator is positioned between the condenser and the flash tank along the refrigerant fluid circuit.

For instance, the refrigerant fluid circuit can be the fluid refrigerant circuit 202 of the sealed system 200 of FIG. 2 or 8. The compressor can be the compressor 210, the condenser can be a condenser 220, the first expansion device can be first expansion device 230, the first evaporator can be first evaporator 240, the flash tank can be flash tank 270, the second expansion device can be second expansion device 250, and the second evaporator can be second evaporator 260. The various components of sealed system 200 can be arranged in serial fluid communication as shown in FIG. 2 or FIG. 8. Moreover, as shown in the embodiments of sealed system 200 of FIGS. 2 and 8, the refrigerant fluid circuit 202 has first supply conduit 292 that fluidly couples vapor outlet 274 of flash tank 270 with the inlet 212 of compressor 210. In addition, the refrigerant fluid circuit 202 has second supply conduit 294 that fluidly couples liquid outlet 276 of flash tank 270 with the inlet 212 of compressor 210. Second expansion device 250 and second evaporator 260 are positioned along second supply conduit 294. More particularly, second expansion device 250 is positioned upstream of second evaporator 260 along second supply conduit 294. First evaporator 240 is positioned between condenser 220 and flash tank 270 along refrigerant fluid circuit 202. Compressor 210 is operable to flow the refrigerant fluid through the refrigerant fluid circuit 202.

In some implementations, sealed system 200 is employed and a refrigerator appliance having a fresh food chamber and a freezer chamber. For instance, sealed system 200 can be employed in the refrigerator appliance 100 of FIG. 1. In such implementations, first evaporator 240 can be associated with cooling fresh food chamber 104 and second evaporator 260 can be associated with cooling freezer chamber 108. As will be explained further below, method (400) provides a means for cooling first evaporator 240 and second evaporator 260 simultaneously using a single compressor.

At (404), the method (400) includes switching one or more valves positioned between the flash tank and the compressor to switch a flow of the refrigerant fluid to the inlet of the compressor between: i) the vapor outlet of the flash tank and the inlet of the compressor along the first supply conduit, and ii) the liquid outlet of the flash tank and the inlet of the compressor along the second supply conduit, wherein the one or more valves selectively switch the flow of the refrigerant fluid to the inlet of the compressor at a frequency based at least in part on a heat load applied on the first evaporator and a heat load applied on the second evaporator.

For instance, the one or more valves can include a single multiway valve 280 positioned between flash tank 270 and compressor 210 as shown in FIG. 2 and FIG. 8. Moreover, multiway valve 280 is positioned downstream of second evaporator 260 along refrigerant fluid circuit 202. During operation of compressor 210, a controller 290 can control multiway valve 280 to switch the flow of the refrigerant fluid to the inlet 212 of compressor 210 between the different evaporators relatively frequently (e.g., on the order of seconds). That is, the refrigerant flow is switched such that compressor 210 sees a suction pressure SP1 associated with the first outlet pressure P1 output by first evaporator 240 for a first period of time, and then when multiway valve 280 is switched, the compressor 210 sees a suction pressure SP2 associated with the second outlet pressure P2 output by second evaporator 260 for a second period of time and the switching operation continues for the duration of operation of compressor 210.

More particularly, when multiway valve 280 is switched to a first position (e.g., so that first evaporator 240 is the "on" evaporator and second evaporator 260 is the "off" evaporator), the refrigerant fluid in a primarily vapor phase exits the vapor outlet 274 of flash tank 270 and flows along first supply conduit 292 and through multiway valve 280 to the inlet of the compressor 210. When multiway valve 280 is switched to a second position (e.g., so that first evaporator 240 is the "off" evaporator and second evaporator 260 is the "on" evaporator), the refrigerant fluid in a primarily liquid phase exits the liquid outlet 276 of flash tank 270 and flows along second supply conduit 294. The primarily liquid phase refrigerant fluid is expanded by second expansion device 250 and then travels downstream to second evaporator 260 to provide cooling. The now primarily vapor phase refrigerant fluid exits second evaporator 260 and continues along second supply conduit 294 where the flow passes through multiway valve 280 to the inlet 212 of compressor 210. Controller 290 causes multiway valve 280 to selectively switch the flow of the refrigerant fluid to the inlet 212 of compressor 210 at a frequency based at least in part on a heat load applied on first evaporator 240 and a heat load applied on the second evaporator 260. Controller 290 can also cause multiway valve 280 to selectively switch the flow of the refrigerant fluid to the inlet 212 of compressor 210 at the frequency such that a temperature increase in the first evaporator 240 and the second evaporator 260 is negligible during operation of multiway valve 280.

For instance, with reference to FIG. 5, if the heat load on the first evaporator 240 is sixty watts (60 W) and the heat load on the second evaporator is one hundred twenty watts (120 W), then controller 290 determines that multiway valve 280 must switch to the first position at least every four (4) seconds and to the second position at least every two (2) seconds to prevent an increase in temperature of the evaporator by five tenths of a degree Fahrenheit (0.5° F.), which in this example is considered more than a negligible temperature increase. Thus, the multiway valve 280 can be switched back and forth between the first and second positions to prevent temperature increases in the evaporators 240, 260 during operation of compressor 210. It will be appreciated that multiway valve 280 provided in the example above is for example only and that other valve configurations and valve control schemes are possible, such as e.g., the valve configuration shown in FIG. 8. Advantageously, the relatively frequent switching of the valves described in method (400) allows for a sealed system having multi-evaporators fluidly coupled in series to simultaneously cooling the evaporators whilst effectively operating in a sequential manner using a single compressor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A sealed system for an appliance, comprising:

a compressor having an inlet and an outlet;

a condenser fluidly coupled with the outlet of the compressor and operable to receive a refrigerant fluid from the compressor;

a first expansion device fluidly coupled with an outlet of the condenser;

a first evaporator fluidly coupled with an outlet of the first expansion device and operable to output the refrigerant fluid at a first outlet pressure;

a second evaporator fluidly coupled with the first evaporator in series and operable to output the refrigerant fluid at a second outlet pressure that is different than the first outlet pressure;

a flash tank fluidly coupled with the first evaporator and the second evaporator and positioned therebetween, the flash tank having a vapor outlet and a liquid outlet, the second evaporator positioned between the liquid outlet of the flash tank and the inlet of the compressor;

a second expansion device positioned between and fluidly coupled with the liquid outlet of the flash tank and the second evaporator; and one or more valves operable to selectively switch a flow of the refrigerant fluid to the inlet of the compressor between:

i) the vapor outlet of the flash tank and the inlet of the compressor, and ii) the liquid outlet of the flash tank and the inlet of the compressor through the second evaporator, wherein the one or more valves selectively switch the flow of the refrigerant fluid to the inlet of the compressor at a frequency such that a temperature increase in the first evaporator is negligible and such that a temperature increase in the second evaporator is negligible during operation of the one or more valves.

2. The sealed system of claim 1, wherein the temperature increase in the first evaporator is negligible where the temperature increase is less than or equal to about two degrees Fahrenheit (2° F.) and the temperature increase in the second evaporator is negligible where the temperature increase is less than or equal to about two degrees Fahrenheit (2° F.).

3. The sealed system of claim 1, wherein the temperature increase in the first evaporator is negligible where the temperature increase is less than or equal to about five tenths of a degree Fahrenheit (0.5° F.) and the temperature increase in the second evaporator is negligible where the temperature increase is less than or equal to about five tenths of a degree Fahrenheit (0.5° F.).

4. The sealed system of claim 1, wherein the one or more valves selectively switch the refrigerant flow to the inlet of the compressor every twelve (12) seconds or less during operation of the compressor.

5. The sealed system of claim 1, wherein the one or more valves selectively switch the refrigerant flow to the inlet of the compressor at the frequency based at least in part on a heat load applied on the first evaporator and a heat load applied on the second evaporator.

6. The sealed system of claim 1, further comprising:

a controller communicatively coupled with the one or more valves, the controller configured to:

switch the one or more valves to selectively switch the refrigerant flow to the inlet of the compressor between:

i) the vapor outlet of the flash tank and the inlet of the compressor, and ii) the liquid outlet of the flash tank and the inlet of the compressor through the second evaporator at the frequency such that the temperature increase in the first evaporator and the second evaporator is negligible during operation of the one or more valves.

7. The sealed system of claim 1, further comprising:

a first evaporator fan operable to move air across the first evaporator; and a second evaporator fan operable to move air across the second evaporator, and wherein the first evaporator fan moves air across the first evaporator and the second evaporator moves air across the second evaporator fan continuously throughout operation of the compressor.

8. The sealed system of claim 1, wherein the one or more valves have a response time of five hundred milliseconds (500 ms) or less.

9. The sealed system of claim 1, wherein the one or more valves comprise a multiway valve, and wherein the sealed system further comprises:

a first supply conduit fluidly coupling the vapor outlet of the flash tank and the multiway valve;

a second supply conduit fluidly coupling the liquid outlet of the flash tank and the multiway valve; and a delivery conduit fluidly coupling the multiway valve with the inlet of the compressor.

10. The sealed system of claim 1, wherein the one or more valves comprise a first valve and a second valve, and wherein the sealed system further comprises:

a first supply conduit fluidly coupling the vapor outlet of the flash tank and the inlet of the compressor, the first valve positioned along the first supply conduit;

a second supply conduit fluidly coupling the liquid outlet of the flash tank and the inlet of the compressor through the second evaporator.

11. The sealed system of claim 10, further comprising:

a controller communicatively coupled with the first valve and the second valve, the controller configured to:

switch the first valve between an open position and a closed position and the second valve between an open position and a closed position, and wherein the controller is configured to switch the first valve between the open position and the closed position and the second valve between the open position and the closed position such that when:

i) the first valve is switched to the open position, the second valve is switched to the closed position; and ii) the first valve is switched to the closed position, the second valve is switched to the open position.

12. The sealed system of claim 1, wherein the compressor is the only compressor of the sealed system.

13. The sealed system of claim 1, further comprising:

a first supply conduit fluidly coupling the vapor outlet of the flash tank and the inlet of the compressor;

a second supply conduit fluidly coupling the liquid outlet of the flash tank and the inlet of the compressor, and wherein the second evaporator is positioned along the second supply conduit, and wherein the flash tank is operable to separate a phase of the refrigerant fluid into a primarily vapor phase and a primarily liquid phase, and wherein the primarily vapor phase flows to the inlet of the compressor via the first supply conduit and the primarily liquid phase flows to the second evaporator via the second supply conduit.

14. A sealed system for an appliance, comprising:

a compressor having an inlet and an outlet;

a condenser fluidly coupled with the outlet of the compressor and operable to receive a refrigerant fluid from the compressor;

a first conduit;

a second conduit;

a first expansion device positioned along the first conduit and fluidly coupled with the condenser;

a first evaporator positioned along the first conduit downstream of the first expansion device, the first evaporator operable to output the refrigerant fluid at a first outlet pressure;

a second expansion device positioned along the second conduit and fluidly coupled with the condenser;

a second evaporator positioned along the second conduit downstream of the second expansion device and fluidly coupled with the first evaporator in parallel, the second evaporator operable to output the refrigerant fluid at a second outlet pressure that is different than the first outlet pressure;

one or more upstream valves positioned downstream of the condenser and upstream of the first evaporator and the second evaporator, the one or more upstream valves operable to selectively allow a flow of the refrigerant fluid along at least one of i) the first conduit, and ii) the second conduit; and one or more downstream valves operable to selectively switch the flow of the refrigerant fluid to the inlet of the compressor between:

i) the first conduit and the inlet of the compressor, and ii) the second conduit and the inlet of the compressor, wherein, in coordination, the one or more downstream valves and the one or more upstream valves selectively switch the flow of the refrigerant fluid to the inlet of the compressor at a frequency such that a temperature increase in the first evaporator is negligible and such that a temperature increase in the second evaporator is negligible during operation of the one or more downstream valves and the one or more upstream valves.

15. The sealed system of claim 14, wherein the one or more upstream valves comprise a multiway valve fluidly coupled with the condenser, the first conduit, and the second conduit, and wherein the one or more downstream valves comprise a multiway valve fluidly coupled with the first conduit, the second conduit, and the inlet of the compressor.

16. The sealed system of claim 14, wherein the one or more upstream valves comprise a multiway valve fluidly coupled with the condenser, the first conduit, and the second conduit, and wherein the one or more downstream valves comprise a first downstream valve positioned along the first conduit downstream of the first evaporator.

17. The sealed system of claim 14, wherein the one or more upstream valves comprise a multiway valve fluidly coupled with the condenser, the first conduit, and the second conduit, and wherein the one or more downstream valves comprise a first downstream valve and a second downstream valve, wherein the first downstream valve is positioned along the first conduit downstream of the first evaporator and the second downstream valve is positioned along the second conduit downstream of the second evaporator.

18. The sealed system of claim 14, wherein the one or more upstream valves comprise a first upstream valve and a second upstream valve, wherein the first upstream valve is positioned along the first conduit upstream of the first evaporator and the second upstream valve is positioned along the second conduit upstream of the second evaporator, and wherein the one or more downstream valves comprise a multiway valve fluidly coupled with the first conduit, the second conduit, and the inlet of the compressor.

19. The sealed system of claim 14, wherein the one or more upstream valves comprise a second upstream valve, wherein the second upstream valve is positioned along the second conduit upstream of the second evaporator, and wherein the one or more downstream valves comprise a first downstream valve, wherein the first downstream valve is positioned along the first conduit downstream of the first evaporator.

20. The sealed system of claim 14, wherein the one or more upstream valves comprise a first upstream valve and a second upstream valve, wherein the first upstream valve is positioned along the first conduit upstream of the first evaporator and the second upstream valve is positioned along the second conduit upstream of the second evaporator, and wherein the one or more downstream valves comprise a first downstream valve and a second downstream valve, wherein the first downstream valve is positioned along the first conduit downstream of the first evaporator and the second downstream valve is positioned along the second conduit downstream of the second evaporator.

21. The sealed system of claim 14, wherein the one or more downstream valves selectively switch the refrigerant flow to the inlet of the compressor every twelve (12) seconds or less during operation of the compressor.

22. The sealed system of claim 14, wherein the one or more downstream valves selectively switch the refrigerant flow to the inlet of the compressor at the frequency based at least in part on a heat load applied on the first evaporator and a heat load applied on the second evaporator.

23. The sealed system of claim 14, wherein the one or more upstream valves and the one or more downstream valves have a response time of five hundred milliseconds (500 ms) or less.

24. A method for operating a sealed system of an appliance, the method comprising:

flowing a refrigerant fluid through a refrigerant fluid circuit of the sealed system having a compressor, a condenser, a first expansion device, a first evaporator, a flash tank, a second expansion device, and a second evaporator fluidly coupled in series, wherein the refrigerant fluid circuit has a first supply conduit that fluidly couples a vapor outlet of the flash tank with an inlet of the compressor, and a second supply conduit that fluidly couples a liquid outlet of the flash tank with the inlet of the compressor through the second evaporator, wherein the second expansion device and the second evaporator are positioned between the flash tank and the compressor along the second supply conduit, and the first evaporator is positioned between the condenser and the flash tank along the refrigerant fluid circuit; and switching one or more valves positioned between the flash tank and the compressor to switch a flow of the refrigerant fluid to the inlet of the compressor between:

i) the vapor outlet of the flash tank and the inlet of the compressor along the first supply conduit, and ii) the liquid outlet of the flash tank and the inlet of the compressor along the second supply conduit, wherein the one or more valves selectively switch the flow of the refrigerant fluid to the inlet of the compressor at a frequency such that a temperature increase in the first evaporator is negligible and such that a temperature increase in the second evaporator is negligible during operation of the one or more valves.

* * * * *